US010179294B2

(12) United States Patent
Russo et al.

(10) Patent No.: US 10,179,294 B2
(45) Date of Patent: Jan. 15, 2019

(54) BIDIRECTIONAL GEAR ASSEMBLY FOR ELECTROMECHANICAL TOYS

(71) Applicant: Hasbro, Inc., Pawtucket, RI (US)

(72) Inventors: John J Russo, Mansfield, MA (US); Richard J Maddocks, Barrington, RI (US); Paul Nicholas Paulson, East Greenwich, RI (US)

(73) Assignee: Hasbro, Inc., Pawtucket, RI (US)

( * ) Notice: Subject to any disclaimer, the term of this patent is extended or adjusted under 35 U.S.C. 154(b) by 70 days.

(21) Appl. No.: 15/445,609

(22) Filed: Feb. 28, 2017

(65) Prior Publication Data

US 2017/0182428 A1 Jun. 29, 2017

Related U.S. Application Data

(62) Division of application No. 14/318,447, filed on Jun. 27, 2014, now Pat. No. 9,586,156.

(51) Int. Cl.
*A63H 31/00* (2006.01)
*A63H 11/10* (2006.01)

(52) U.S. Cl.
CPC ..... *A63H 31/00* (2013.01); *A63H 11/10* (2013.01)

(58) Field of Classification Search
CPC ..... A63H 31/00; A63H 31/08; F16H 21/26; F16H 21/28
USPC ..... 74/70–73, 321, 322, 337.5, 340
See application file for complete search history.

(56) References Cited

U.S. PATENT DOCUMENTS

| | | | |
|---|---|---|---|
| 453,781 | A | 6/1891 | Allen |
| 2,149,180 | A | 2/1939 | Muller |
| 2,169,663 | A | 8/1939 | Shanley |
| 2,540,573 | A | 2/1951 | Evans |
| 4,135,328 | A | 1/1979 | Yamasaki |
| 4,231,182 | A | 11/1980 | Kurita |
| 4,245,515 | A | 1/1981 | Iwaya |
| 4,290,227 | A | 9/1981 | Shimamura |

(Continued)

FOREIGN PATENT DOCUMENTS

| | | | |
|---|---|---|---|
| GB | 1587072 | A | 3/1981 |
| GB | 2288987 | A | 11/1995 |

(Continued)

OTHER PUBLICATIONS

PCT/US2014/044879—International Search Report. dated Oct. 29, 2014.

(Continued)

*Primary Examiner* — Victor L MacArthur
(74) *Attorney, Agent, or Firm* — Perry Hoffman

(57) ABSTRACT

A gear mechanism having a shuttle gear adjacent both an auxiliary gear and an action gear and a cam plate, having a shuttle lock adjacent the shuttle gear and including a cam follower riding back and forth along a first cam pathway with an action element in mechanical communication with the action gear. A motor operates the shuttle gear with rotation of the motor in a first direction rotating the shuttle gear into engagement with the auxiliary gear, activating the shuttle lock to maintain the engagement throughout a predetermined rotational range of the cam plate and rotating the cam plate back and forth driving controlled back and forth movement of the auxiliary elements, with rotation of the motor in a second direction rotating the cam plate beyond the predetermined range releasing the shuttle lock.

13 Claims, 16 Drawing Sheets

(56) References Cited

U.S. PATENT DOCUMENTS

| | | | |
|---|---|---|---|
| 4,377,918 | A | 3/1983 | Zbriger |
| 4,400,698 | A | 8/1983 | Wessels et al. |
| 4,752,272 | A | 6/1988 | Karasawa |
| 4,795,395 | A | 1/1989 | Oishi et al. |
| 5,090,936 | A | 2/1992 | Satoh et al. |
| 5,503,586 | A | 4/1996 | Suto |
| 5,629,923 | A | 5/1997 | Hisatomi |
| 6,039,626 | A | 3/2000 | Gerold et al. |
| 6,371,826 | B1 | 4/2002 | Pestonji |
| 6,386,058 | B1 | 5/2002 | Lu |
| 6,416,380 | B1 | 7/2002 | Li-Wen |
| 6,497,607 | B1 | 12/2002 | Hampton et al. |
| 6,503,123 | B2 | 1/2003 | Chung |
| 6,505,527 | B2 | 1/2003 | Lu |
| 6,514,117 | B1 | 2/2003 | Hampton et al. |
| 6,537,127 | B1 | 3/2003 | Lund et al. |
| 6,537,128 | B1 | 3/2003 | Hampton et al. |
| 6,544,098 | B1 | 4/2003 | Hampton et al. |
| 6,565,407 | B1 | 5/2003 | Woolington et al. |
| 6,579,143 | B1 | 6/2003 | Rehkemper et al. |
| 6,609,440 | B1 | 8/2003 | Chu |
| 6,732,602 | B2 | 5/2004 | Lu |
| 6,746,301 | B1 | 6/2004 | Lund et al. |
| 6,991,511 | B2 | 1/2006 | Maggiore et al. |
| 7,066,782 | B1 | 6/2006 | Maddocks et al. |
| 7,115,014 | B2 | 10/2006 | McGrath et al. |
| 7,150,671 | B2 | 12/2006 | Maleika |
| 7,159,483 | B2 | 1/2007 | Yamanaka |
| 7,431,629 | B1 | 10/2008 | Maddocks et al. |
| 8,231,426 | B2 | 7/2012 | Miller |
| 9,067,149 | B2 | 6/2015 | Byers |
| 2002/0090883 | A1 | 7/2002 | Lu |
| 2004/0045385 | A1 | 3/2004 | Lu |
| 2006/0270312 | A1 | 11/2006 | Maddocks et al. |
| 2009/0277057 | A1 | 11/2009 | Nagaoka et al. |

FOREIGN PATENT DOCUMENTS

| | | | |
|---|---|---|---|
| JP | 2003164673 | A | 6/2003 |
| SU | 1018659 | A | 5/1985 |
| SU | 1526713 | A | 12/1989 |
| WO | 0007682 | A1 | 2/2000 |

OTHER PUBLICATIONS

PCT/US2014/044879—Written Opinion of the International Searching Authority, dated Oct. 29, 2014.

PCT/US2014/044879—Notification of Transmittal of the International Search Report and the Written Opinion of the International Searching Authority or the Declaration. dated Oct. 29, 2014.

BIDIRECTIONAL GEAR ASSEMBLY FOR ELECTROMECHANICAL TOYS

PRIORITY CROSS-REFERENCE TO RELATED APPLICATIONS

This application claims priority pursuant to 35 U.S.C. 119(e) from U.S. Provisional Patent Application, No. 61/842,202 filed on Jul. 2, 2013, and this application claims priority as a divisional application of U.S. patent application Ser. No. 14/318,447 filed on Jun. 27, 2014.

BACKGROUND OF THE INVENTION

1. Field of the Invention

The present invention relates to electromechanical toys, and more particularly to a gear assembly for an electromechanical toy employing a shuttle lock device for simple yet unique controlling of back and forth movements of a plurality of auxiliary elements as well as driving whole toy actions such as locomotion off a single motor. The invention also relates to a method for driving auxiliary movements and whole toy actions in an electromechanical toy employing a single motor.

2. Background of the Invention

There are many known electromechanical toys which employ gear mechanisms powered by one or more reversible motors for activating and controlling the movements of the toy. Some of the gear mechanisms are employed to propel the toy forward and/or backward and some of the gear mechanisms additionally actuate accessory features of the electromechanical toy. It is well known to employ a gear mechanism to translate alternately the rotational motion from a reversible motor to first and second drivetrains. Driving a reversible motor in a first direction powering a first drivetrain with a first spur gear, and then reversing the motor to a second direction activating a swing mechanism or the like for switching power to a second gear/spur that engages the second drivetrain, is known to drive forward and backward motion and/or movement of accessory features in a toy.

Additionally, employing two or more reversible motors in conjunction with a cam assembly to power and coordinate various body parts linked to the cam assembly is also known as a mechanism for producing animated responses in an electromechanical toy according to a cyclical pattern and corresponding to external stimuli. None of the known mechanisms however, employ a bidirectional motor/cam follower feature facilitated with a shuttle lock mechanism for controlling (noncyclical) back and forth movement of a plurality of auxiliary elements as well as driving whole toy actions such as locomotion off a single motor.

There are several known devices which employ a swing mechanism or the like to alternatively translate rotational motion from the motor to the first drivetrain adapted to drive a wheel and a second drive train adapted to actuate an accessory feature. A gear box for a toy vehicle adapted to alternately transmit power from a motor to a first and a second drive train is exemplified and disclosed in U.S. Pat. No. 8,231,426 B2, issued Jul. 31, 2012 for "Gearbox assembly for toy vehicles" to Miller. Miller employs a generally known "swing mechanism" concept with a gearbox for a toy vehicle adapted to alternately drive power between a first drivetrain, to drive a wheel, and a second drivetrain system adapted to actuate an accessory feature.

Additionally, known mechanisms for controlling a movable gear on a transmission shaft of a toy car which shifts between a first transmission gear wheel and a second transmission gear wheel to control forward/backward movement of the toy car, is exemplified and disclosed in U.S. Pat. No. 6,386,058 B1 issued May 14, 2002 for "Forward/backward steering control mechanism for a remote-controlled toy car" to Lu, and U.S. Pat. No. 6,505,527 B2 issued Jan. 14,2003 for "Remote-controlled toy car forward/backward steering control mechanism to Lu. In the Lu U.S. Pat. No. 6,386,058 patent, a forward/backward steering control mechanism is coupled to the power drive to move a gear on the transmission shaft between first and second positions to control the direction of rotation of the transmission shaft to further control forward/backward movement of the toy car. In the Lu U.S. Pat. No. 6,505,527 patent, a gear on a transmission shaft of a toy car is moved between a first transmission gear wheel, coupled to a power drive, and a second transmission gear wheel, coupled to the first transmission gear wheel through idle gears, to control the direction of rotation of the transmission shaft thereby controlling forward/backward movement of the toy car.

The Lu patents improves upon a system employing two separately controlled transmission mechanisms for forward and backward movements, and the Lu B2 patent uses a simple gear clutch structure to control switching between forward mode and backward mode. Additionally, U.S. Pat. No. 6,732,602 B2 issued May 11,2004 for "Dual-gearshift forward backward control mechanism for remote control toy car" to Lu discloses a dual-gearshift mechanism to control forward/backward motion and high/low speed gearshift by means of power transmission, through a two-step gearshift control mechanism and a forward backward control mechanism.

Employing a simple gear system with a direction control element for steering a toy vehicle is exemplified and disclosed in U.S. Pat. No. 5,503,586, for "Steering Apparatus" issued Apr. 2, 1996 to Suto. A gear system employs a pair of output gears which are controlled to rotate in the same or opposite direction for steering a toy vehicle. A reversible motor drives a pair of steering gears in opposite directions on the same axis and a direction control element is disposed on the same axis and moved from first to second positions by a cam mechanism driven by the motor. The direction control element engages one steering gear at a time, controlling the rotational direction of the motor such that the vehicle moves ahead or makes a turn.

Additionally, another simple mechanism employed to provide an automatic reversal of toy vehicle movement in the opposite direction is exemplified and disclosed in U.S. Pat. No. 2,149,180, issued May 21, 1937 for "Mechanically Propelled Toy with Automatic Reversal in the Opposite Direction" to Muller. A gear mechanism employing a switch spur-gear is slidably keyed to an axle which mounts drive wheels. The switch spur-gear directs a spur wheel to slide along the axle into engagement with one of two toothed wheels to produce a powerful slow running backward travel of the toy vehicle and then switch to rapid forward movement.

Additionally, employing more than one reversible motor in conjunction with a cam assembly to power and coordinate various body parts linked to the cam assembly for producing smile expressions and simulating emotional states is exemplified and disclosed in US Patent Application Publication No. 2006/0270312 A1 issued Nov. 30, 2006 for "Interactive Animated Characters" to Maddocks et al. An animated character having a variety of moving body parts including a smile/emotion assembly are coordinated to exhibit life-like emotional states by controlling and synchronizing their movements in response to external sensors. A drive system utilizes first and second reversible motors in conjunction with a cam operating mechanism linked to various body parts to coordinate cyclical movements which mimic life-like emotions and respond to external sensor coupled to the electromechanical toy.

Another electromechanical toy disclosed in U.S. Pat. No. 6,579,143 B1, issued Jun.17, 2003 for "Twisting and Dancing Figure" to Rehkemper et at. describes a twisting figure that includes a head, body, arms and lower leg sections. A housing formed in the body contains a motor secured between a pair of horizontal plates pivotally secured to the lower leg section. A gear assembly is arranged to reciprocate against a bumper that is secured to the lower leg section causing twisting movements of the figure.

Significantly, known electromechanical toys do not include a gear assembly employing a shuttle lock device for simple yet unique controlling of back and forth movements of a plurality of auxiliary elements as well as driving whole toy actions such as locomotion off a single motor.

It would be desirable to provide a motor driven gear mechanism including a shuttle gear adjacent both an action gear and an auxiliary gear with a cam plate linked to auxiliary elements driven by the auxiliary gear. A shuttle lock is positioned at the shuttle gear maintaining the shuttle gear and auxiliary gear together to rotate both in a forward and reverse direction for rotating the cam plate back and forth for operating the auxiliary elements.

An actuating mechanism is employed to position the shuttle lock to maintain the shuttle gear and auxiliary gear together for operating the auxiliary elements, with the shuttle gear engaging the action gear for movement of the action elements when the actuating mechanism no longer has the shuttle lock positioned at the shuttle gear. Additionally it is also desirable to provide motor driven actuation of the shuttle lock including a shuttle lock cam follower riding along a first follower pathway in the cam plate, with rotation of the motor in a first direction driving the shuttle gear into engagement with the auxiliary gear and actuating the shuttle lock to maintain the shuttle gear and auxiliary gear together for controlling back and forth movement of the auxiliary elements throughout a predetermined rotational range of the cam plate. Rotation of the motor in a second direction releases the shuttle lock as the cam rotates outside the predetermined rotational range driving the shuttle gear into engagement with the action gear for driving action movement such as locomotion of the toy.

SUMMARY OF THE INVENTION

The present invention addresses shortcomings of the prior art to provide a gear mechanism for an electromechanical toy employing a shuttle lock device for simple yet unique controlling of back and forth movement of a plurality of auxiliary elements as well as driving whole toy actions such as locomotion off a single motor.

In one embodiment of the invention, a gear mechanism for an electromechanical toy includes a shuttle gear having a first and second working surface, an auxiliary gear disposed adjacent the shuttle gear and having a receiving surface for engaging the first working surface of the shuttle gear, a rotating cam plate having a cam surface and one or more follower pathways at the cam surface, the cam plate being driven by the auxiliary gear, one or more auxiliary elements operating with the cam plate, each auxiliary element including a cam follower riding back and forth along one of said follower pathways, a shuttle lock disposed adjacent the shuttle gear, an action gear disposed adjacent the shuttle gear opposite the auxiliary gear having a receiving surface for engaging the second working surface of the shuttle gear, an action element moving with the action gear, and a motor driving rotation of the shuttle gear with rotation of the motor in a first and second direction driving rotation of the shuttle gear in a forward and reverse direction. An actuating mechanism is further in mechanical communication with the shuttle lock positioning the shuttle lock to maintain the first working surface of the shuttle gear with the receiving surface of the auxiliary gear when the shuttle lock is positioned at the shuttle gear maintaining the shuttle gear and the auxiliary gear together to rotate both in a forward and a reverse direction for rotating the cam plate back and forth for operating the auxiliary elements, the second working surface of the shuttle gear engaging with the receiving surface of the action gear when the actuating mechanism no longer has the shuttle lock positioned at the shuttle gear.

In another embodiment the first working surface further includes one or more curved sloping projections arranged in a circular path along the shuttle gear and the receiving surface of the auxiliary gear further includes one or more curved sloping projections arranged in a circular path along the auxiliary gear, the working surface projections and the receiving surface projections are keyed to mate with one another and tightly engage the shuttle gear and auxiliary gear to rotate together in a forward and reverse direction. In another embodiment, the actuating mechanism further includes a solenoid system including a solenoid to extend and position the shuttle lock at the shuttle gear, and in another embodiment the auxiliary gear is driven to perform a first auxiliary function and the action gear is driven to perform a second auxiliary function.

In yet another embodiment, a second shuttle lock is further included and disposed adjacent the shuttle gear for maintaining the second working surface of the shuttle gear together in engagement with the receiving surface of the action gear, and in another embodiment, a second actuating mechanism is further included and in mechanical communication with the second shuttle lock positioning the second shuttle lock to maintain the shuttle gear and the action gear together to rotate both in a forward and reverse direction. In yet another embodiment, the actuating mechanism further includes a first follower pathway at the cam plate and a cam follower at the shuttle lock for riding back and forth along the first follower pathway positioning the shuttle lock at the shuttle gear throughout a predetermined rotational range of the cam plate, and the second actuating mechanism further includes a second cam plate having a second follower pathway and a second cam follower at the second shuttle lock for riding back and forth along the second pathway when the first cam follower has moved beyond the predetermined rotational range positioning the second shuttle lock at the shuttle gear throughout a predetermined rotational range of the second cam plate.

In one embodiment of the invention, a gear mechanism for an electromechanical toy includes a shuttle gear having a first and second engaging surface and including teeth disposed at each of the first and second engaging surface, an auxiliary gear disposed adjacent the shuttle gear having a receiving surface and including teeth at the receiving surface to engage teeth of the shuttle gear, a rotating cam plate having a cam surface and one or more follower pathways at the cam surface, the cam plate is in rotatable mechanical communication with the auxiliary gear. One or more auxiliary elements are further included and in mechanical communication with the cam plate, each auxiliary element including a cam follower riding back and forth along a follower pathway, a shuttle lock disposed adjacent the shuttle gear and including a cam follower riding back and forth along a first cam pathway, an action gear disposed adjacent the shuttle gear opposite the auxiliary gear having a receiving surface and including teeth at the receiving surface, and an action element in mechanical communication with the action gear.

A motor is further included and in mechanical communication with the shuttle gear with rotation of the motor in a first direction rotating the shuttle gear into engagement with the auxiliary gear engaging shuttle and auxiliary gear teeth and activating the shuttle lock to maintain the shuttle and auxiliary gear engagement throughout a predetermined rotational range of the cam plate and rotating the cam plate back and forth driving controlled back and forth movement of the auxiliary elements. Rotation of the motor in a second direction rotating the cam plate beyond the predetermined range releasing the shuttle lock and rotating the shuttle gear into engagement with the action gear engaging shuttle and action gear teeth and driving action movement of the toy.

In another embodiment of the invention, the shuttle gear teeth of the first engaging surface and the auxiliary gear teeth of the receiving surface further comprise stepped squared off teeth keyed to mate with one another when the shuttle gear engages the auxiliary gear. In another embodiment the shuttle lock cam follower comprises a pin disposed on the shuttle lock for riding back and forth in the first follower pathway of the cam maintaining the shuttle lock in an active position and the shuttle gear in locked engagement with the auxiliary gear.

In another embodiment of the invention, a pathway extension in the first follower pathway is further provided and offset from the defined pathway for capturing the pin and shifting the shuttle lock to an inactive position and out of locked engagement with the shuttle gear. In another embodiment, the rotatable cam plate and shuttle lock are mounted on a common shaft and further included are one or more additional cam plates coaxially mounted on the shaft adjacent the rotatable cam plate and in rotatable mechanical communication with the auxiliary gear, each additional cam plate having a cam surface and one or more follower pathways at the cam surface.

In yet another embodiment of the invention, the auxiliary elements further include at least one or more of the following: a head element, mouth element, eye element, snout element, hind legs element, and tail element, and in another embodiment the action element further includes one or more wheel assemblies mechanically engaging the action gear for driving locomotion of the toy. In still yet another embodiment of the invention, the action element further includes a toy torso mechanically engaging the action gear for driving a back and forth wiggling/twisting action and in another embodiment a tension spring is further included and in communication with the shuttle gear urging the shuttle gear to engage the action gear when the shuttle lock is in an inactive position and out of locked engagement with the shuttle gear.

In another embodiment of the invention, a gear mechanism for an electromechanical toy includes a shuttle gear having first and second surfaces and including teeth disposed at each of the first and second surfaces, at least first and second pinion gears disposed adjacent the shuttle gear, each pinion gear having a receiving surface and including teeth disposed at the receiving surface for engaging teeth of the shuttle gear, a shaft, and a rotating cam plate mounted on the shaft and having a cam surface including one or more follower pathways at the cam surface, the rotating cam plate is in mechanical communication with at least the first pinion gear. Further included are one or more auxiliary elements in mechanical communication with the cam plate, each auxiliary element including a cam follower riding back and forth along a follower pathway of the cam, a shuttle lock mounted on the shaft and disposed adjacent the shuttle gear, the shuttle lock including a cam follower riding back and forth along a first follower pathway of the cam, and an action element in mechanical communication with at least the second pinion gear.

A motor is further included and in mechanical communication with the shuttle gear with rotation of the motor in a first direction rotating the shuttle gear into engagement with the first pinion gear engaging the teeth of the shuttle and first pinion gear and activating the shuttle lock to maintain the shuttle and first pinion gear engagement throughout a predetermined rotational range of the cam plate and rotating the cam plate back and forth driving controlled back and forth movement of the auxiliary elements. Rotation of the motor in a second direction rotates the cam plate beyond the predetermined range releasing the shuttle lock and rotating the shuttle gear into engagement with the second pinion gear and driving action movement of the toy.

In another embodiment of the invention, the teeth of shuttle gear at the first surface further include stepped squared off teeth and the teeth of the first pinion gear at the receiving surface further include stepped teeth keyed to mate with the stepped teeth of the shuttle gear. In another embodiment of the invention, a tension spring is further included and in communication with the shuttle gear urging the shuttle gear to engage the second pinion gear when the shuttle lock is in an inactive position and out of locked engagement with the shuttle gear.

In yet another embodiment of the invention, the shuttle lock cam follower includes a pin disposed on the shuttle lock for riding back and forth in the first follower pathway of the cam maintaining the shuttle lock in an active position and the shuttle gear in locked engagement with the first pinion gear. In another embodiment, a pathway extension is further included in the first follower pathway offset from the defined pathway for capturing the pin and shifting the shuttle lock to an inactive position and out of locked engagement with the shuttle gear.

In another embodiment of the invention, a method for generating auxiliary movements with an auxiliary gear and action movements with an action gear from a single motor driving a shuttle gear includes the steps of positioning a first working surface on a first side of the shuttle gear and a second working surface on a second side of the shuttle gear, positioning the auxiliary gear adjacent the first working surface of the shuttle gear, positioning the action gear adjacent the second working surface of the shuttle gear, receiving the first working surface with a receiving surface of the auxiliary gear, rotating a cam plate with the auxiliary gear for generating auxiliary movements with a single motor driving the shuttle gear, the cam plate having a cam surface and including one or more follower pathways at the cam surface, and moving one or more auxiliary elements with one or more auxiliary element cam followers riding back and forth along one of said follower pathways. The steps of actuating a shuttle lock disposed adjacent the shuttle gear is further included to maintain the first working surface of the shuttle gear with the receiving surface of the auxiliary gear when the shuttle lock is positioned at the shuttle gear maintaining the shuttle gear and the auxiliary gear together to rotate both in a forward and a reverse direction for rotating the cam plate back and forth for operating the auxiliary elements, and receiving the second working surface with a receiving surface of the action gear, the second working surface of the shuttle gear engaging with the receiving surface of the action gear when the actuating step no longer has the shuttle lock positioned at the shuttle gear for moving the action gear for generating action movements with the single motor driving the shuttle gear. The motor driving rotation of the shuttle gear with rotation of the motor in a first and second direction driving rotation of the shuttle gear in a forward and reverse direction.

In another embodiment of the invention, a method for driving action and auxiliary movements with a single motor in an electromechanical toy includes the steps of providing a motor, providing a shuttle gear in mechanical communication with the motor and an auxiliary gear adjacent the shuttle gear, the shuttle gear having first and second engaging surfaces and including teeth disposed at each surface, and the auxiliary gear having a receiving surface and including teeth disposed at the receiving surface to engage the teeth of the shuttle gear. Further including the steps of providing a shaft, mounting a rotating cam plate on the shaft in rotatable mechanical communication with the auxiliary gear, the cam plate having a cam surface and including one or more follower pathways at the cam surface, providing one or more auxiliary elements in mechanical communication with the cam plate, each auxiliary element including a cam follower riding back and forth along a follower pathway, mounting a shuttle lock on the shaft, the shuttle lock disposed adjacent the shuttle gear and including a cam follower riding back and forth along a first follower pathway throughout a predetermined rotational range, and providing an action gear disposed adjacent the shuttle gear opposite the auxiliary gear and an action element in mechanical communication with the action gear, the action gear having a receiving surface and including teeth at the receiving surface.

Further providing the steps of rotating the motor in a first direction rotating the shuttle gear into engagement with the auxiliary gear engaging the shuttle and auxiliary gear teeth and activating the shuttle lock to maintain the shuttle and auxiliary gear engagement throughout the predetermined rotational range of the cam plate rotating the cam plate back and forth driving controlled back and forth movement of the auxiliary elements, and rotating the motor in a second direction rotating the cam plate beyond the predetermined range releasing the shuttle lock and rotating the shuttle gear into engagement with the action gear, engaging shuttle and action gear teeth, and driving action movement of the toy.

In another embodiment of the invention, providing stepped teeth at the first engaging surface of the shuttle gear and providing stepped teeth at the receiving surface of the auxiliary gear keyed to mate with the stepped teeth of the shuttle gear is further included. In another embodiment the step of providing a pin is further included and disposed at the shuttle lock for riding back and forth in the first follower pathway of the cam maintaining the shuttle lock in an active position and the shuttle gear in locked engagement with the auxiliary gear and in yet another embodiment, the step of providing a follower pathway is further provided in the first follower pathway offset from the defined pathway for capturing the pin and shifting the shuttle lock to an inactive position and out of locked engagement with the shuttle gear.

In yet another embodiment of the invention, the step of providing a tension spring is further included in communication with the shuttle gear urging the shuttle gear to engage the action gear when the shuttle lock is in an inactive position and out of locked engagement with the shuttle gear.

In still yet another embodiment of the invention, the step of providing one or more additional cam plates is further included and coaxially mounted on the shaft adjacent the rotatable cam plate and in rotatable mechanical communication with the auxiliary gear, each additional cam plate having a cam surface and one or more follower pathways at the cam surface.

The present inventions include a unique gear mechanism for electromechanical toys employing a shuttle lock for simple yet unique controlling of back and forth movement of a plurality of auxiliary elements as well as driving whole toy actions such as locomotion off a single motor. The gear mechanism includes a shuttle gear adjacent an auxiliary gear and an action gear, and is driven by a single reversible motor. A cam plate is in rotational mechanical communication with the auxiliary gear and a plurality of auxiliary elements, for example a dog tail, ears and head, are linked through cam followers to the cam plate. The action gear is linked to action elements, for example wheels in front paws. Rotation of the motor in a first direction drives the shuttle gear into engagement with the auxiliary gear and further engages the shuttle lock device for controlling back and forth movement of the auxiliary elements throughout a predetermined rotational range of the cam, mimicking real life movements in the toy. Rotation of the motor in a second direction releases the shuttle lock as the cam rotates outside the predetermined rotational range driving the shuttle gear out of engagement with the auxiliary gear and into engagement with the action gear for driving action movement such as locomotion of the toy.

Briefly, the present inventions provide a shuttle gear having first and second working surfaces adjacent an auxiliary gear having a receiving surface for engaging the first working surface and an action gear having a receiving surface for engaging the second working surface. A rotating cam plate is driven by the auxiliary gear and one or more auxiliary elements operate with the cam plate through cam followers. An action element moves with the action gear. A shuttle lock is disposed adjacent the shuttle gear and a motor drives rotation of the shuttle gear in a forward and reverse direction. An actuating mechanism is employed to position the shuttle lock to maintain the shuttle gear and auxiliary gear together for operating the auxiliary elements, with the shuttle gear engaging the action gear for movement of the action elements when the actuating mechanism no longer has the shuttle lock positioned at the shuttle gear. Additionally it is also desirable to provide motor driven actuation of the shuttle lock with a shuttle lock cam follower riding along a first follower pathway of the cam plate, with rotation of the motor in a first direction driving the shuttle gear into engagement with the auxiliary gear and actuating the shuttle lock to maintain the shuttle gear and auxiliary gear together for controlling back and forth movement of the auxiliary elements throughout a predetermined rotational range of the cam plate. Rotation of the motor in a second direction releases the shuttle lock as the cam rotates outside the predetermined rotational range driving the shuttle gear into engagement with the action gear for driving action movement such as locomotion of the toy.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents and alternatives are intended to fall within the spirit and scope of the present invention.

Figure 1A:
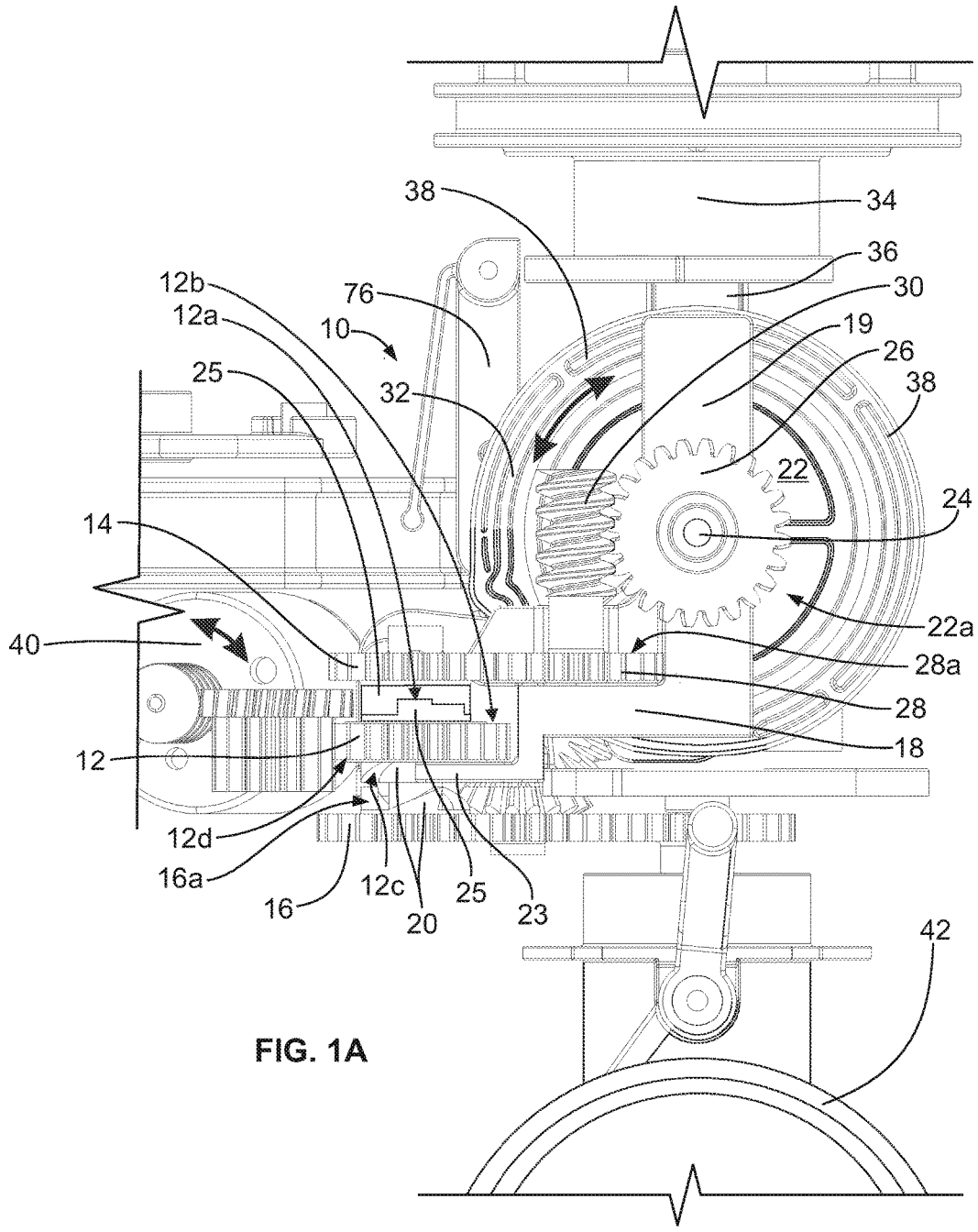
FIG. 1A is a perspective view of a gear mechanism of the present invention illustrating a shuttle gear adjacent both an auxiliary gear and an action gear, with a shuttle lock in an active position maintaining rotational contact between the shuttle gear and the auxiliary gear, with FIG. 1B illustrating the shuttle lock in an inactive position allowing the shuttle gear to engage and rotate the action gear.
Figure 1B:
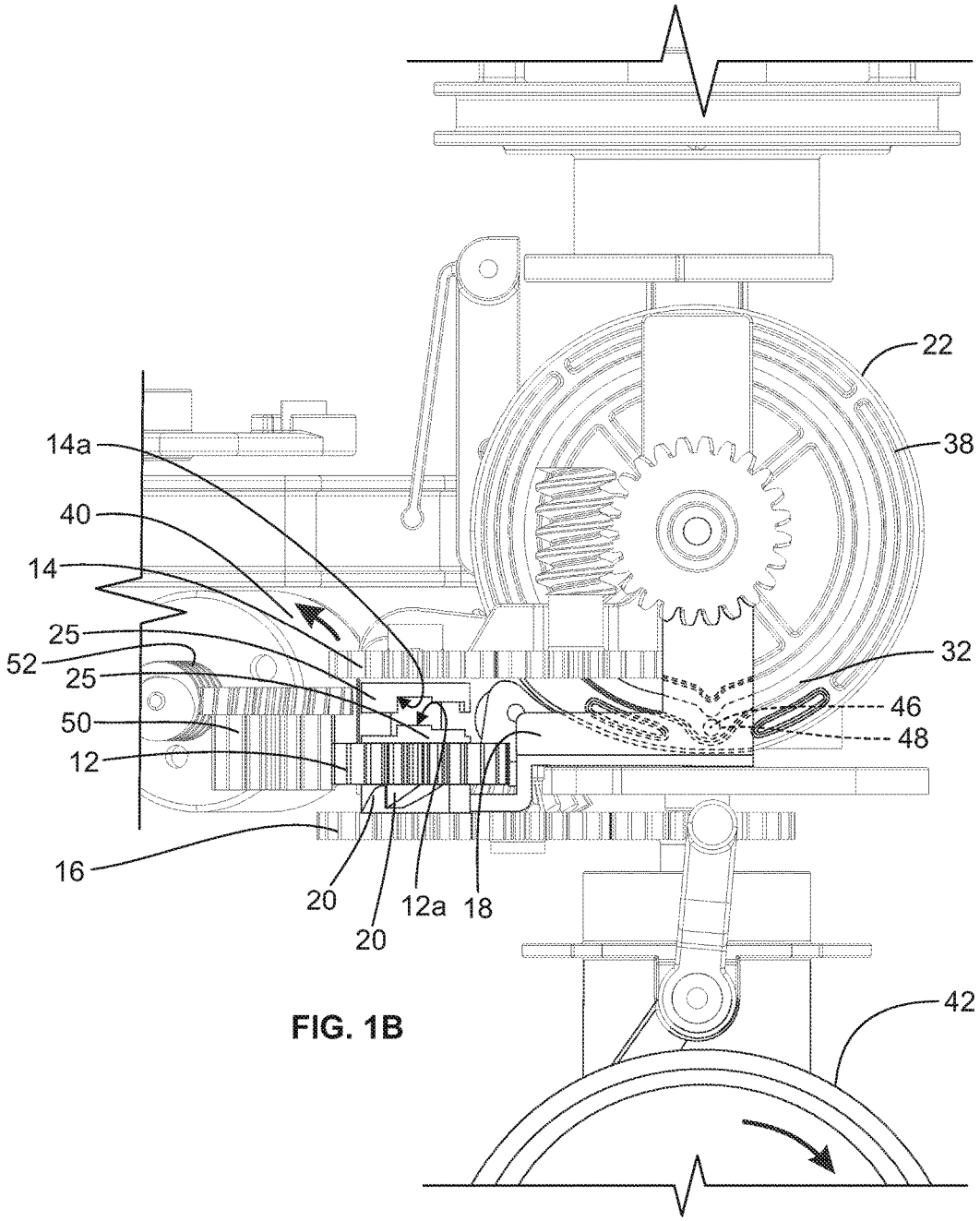

A gear mechanism 10, for an electromechanical toy, as seen in FIGS. 1A -1B, employs a shuttle lock device for simple yet unique controlling of back and forth movements of a plurality of auxiliary elements as well as driving whole toy actions such as locomotion off a single motor.

The gear mechanism 10 is generally seen to include a shuttle gear 12 adjacent both an auxiliary gear 14 and an action gear 16. A rotating cam plate is driven by the auxiliary gear and one or more auxiliary elements operate with the cam plate through cam followers. An action element moves with the action gear. A shuttle lock 18 is disposed adjacent the shuttle gear and positioned at the shuttle gear (active position) to maintain rotatory contact between the shuttle gear and the auxiliary gear for operating a plurality of auxiliary elements. The shuttle gear engages the action gear for movement of the action elements when the shuttle lock is no longer positioned at the shuttle gear (inactive position).

In the present described embodiment, the gears of the gear mechanism 10 are generally manufactured from a heavy duty molded plastic material which is simple and inexpensive to manufacture into any desired shape. Molded plastic is strong and rigid enough to maintain its shape and integrity after many years of use. It is also contemplated that the gears of the gear mechanism 10 can include other materials such as metal, suitable for manufacturing gears which maintain their shape and integrity during use.

The shuttle gear 12, as seen in FIGS. 1A-1B, has a first working surface 12*a* at a first side 12*b* and a second working surface 12*c* at a second side 12*d*. First and second working surfaces 12*a* and 12*b*, respectively, can also be referred to as engaging surfaces. The auxiliary gear 14 is disposed adjacent the shuttle gear 12 and has a receiving surface 14*a* engaging the first working surface 12*a* of the shuttle gear.

The first working surface 12*a* includes one or more curved sloping projections 20 arranged in a circular path along the first side 12*b* of the shuttle gear 12 and the receiving surface 14*a* of the auxiliary gear 14 includes one or more curved sloping projections 20 arranged in a circular path along the auxiliary gear, as seen best seen in FIGS. 1A & 1B. Working surface projections and receiving surface projections are keyed to mate with one another and tightly engage the shuttle gear and auxiliary to rotate together in a forward and reverse direction, as seen in FIG. 1A.

The working surface projections and receiving surface projections 20 can also be called teeth and can include a ramped shape as seen at the second working surface 12*c* of the shuttle gear in FIG. 1A, or the projections of the shuttle gear and the auxiliary gear can include a stepped square shape, as seen in projections (teeth) 25 keyed to mate with one another when the shuttle gear 12 engages the auxiliary gear 14, as seen in FIG. 1A. Regardless of the shape the working surface and receiving surface projections embody, mating projections are sized and shaped to fit one another and provide a secure coupling between the shuttle gear and auxiliary gear rotating together in a forward and reverse direction.

In the present described embodiment, the working surface projections 20 and receiving surface projections 20 provide a secure yet temporary coupling of the shuttle gear and the auxiliary gear, even as the auxiliary gear is rotating in a reverse direction and exerting a force onto the working surface 12*a* of the shuttle gear. Additionally, the stepped square shaped projections 25 also provide a secure yet temporary coupling of the shuttle and auxiliary gears and additionally the square shape of the projections can even reduce the friction exerted on the shuttle gear during the reverse rotation of the auxiliary gear 14 when the shuttle lock 18 is engaged. Reducing the friction exerted on the shuttle gear reduces the current draw on the motor and reduces the overall power needed to operate the toy.

The second working surface 12*c* at the second side 12*b* of the shuttle gear 12 is received at a receiving surface 16*a* of the action gear 16 disposed adjacent the shuttle gear opposite the auxiliary gear. The second working surface 12*c* also includes one or more curved sloping projections 20 arranged in a circular path along the second side 12*b* of the shuttle gear and the receiving surface 16*a* of the action gear includes one or more curved sloping projections 20 arranged in a circular path along the action gear, as seen in FIG. 1A. The second working surface projections 20 and receiving surface projections 20 are keyed to mate with one another and tightly engage the shuttle gear and action gear providing a secure yet temporary coupling to rotate the shuttle gear and the action gear together in a forward and reverse direction. It is also contemplated that the second working surface 12*a* and the receiving surface 16*a* of the action gear can include stepped square projections (teeth) 25 keyed to mate with one another and provide secure yet temporary coupling between the shuttle gear and the action gear, similar to the square projections contemplated at the first working surface 12*a* and the receiving surface of the auxiliary gear.

A rotating cam plate 22 having a cam surface 22*a* and one or more follower pathways 32 at the cam surface is driven by the auxiliary gear 14, as seen in FIG. 1A. In the present described embodiment, the rotating cam plate 22 is securely mounted on a shaft 24 and a flat gear 26 is coaxially mounted on the shaft 24 adjacent the cam plate 22. A pinion gear 28 having a surface 28*a* mounts a worm gear 30 at surface 28*a* extending away from the pinion gear 28. The pinion gear 28 is driven by the auxiliary gear 14 and the mounted worm gear 30 rotatably engages the flat gear 26 for rotating the shaft 24 and secured cam plate 22 in both a clockwise and a counter clockwise direction in response to the rotational direction of the auxiliary gear. Additionally, one or more auxiliary elements 34 operate with the cam plate 22. Each auxiliary element 34 includes a cam follower 36 riding back and forth along one of the follower pathways 32, as seen in FIG. 1A, and discussed in more detail below.

Figure 3:
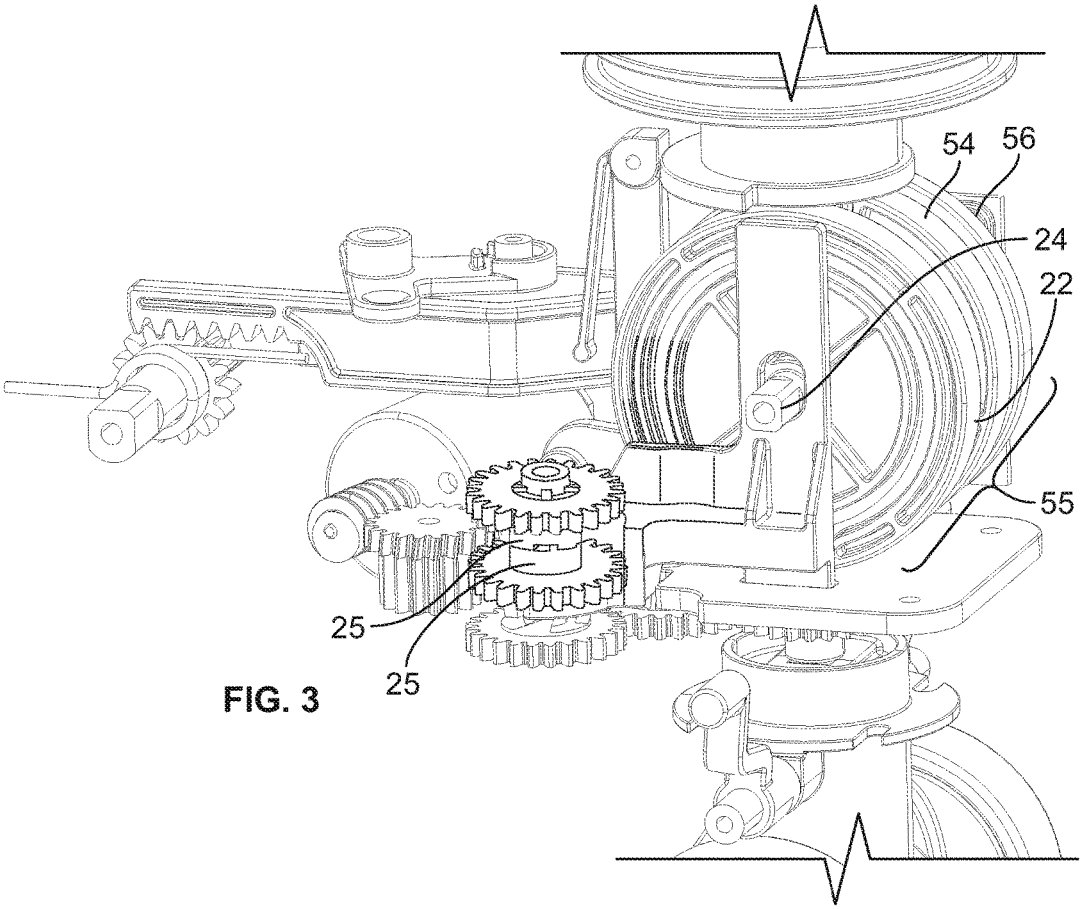
FIG. 3 is a perspective view of the gear mechanism illustrating a cam assembly in mechanical communication with the auxiliary gear.
Figure 8:
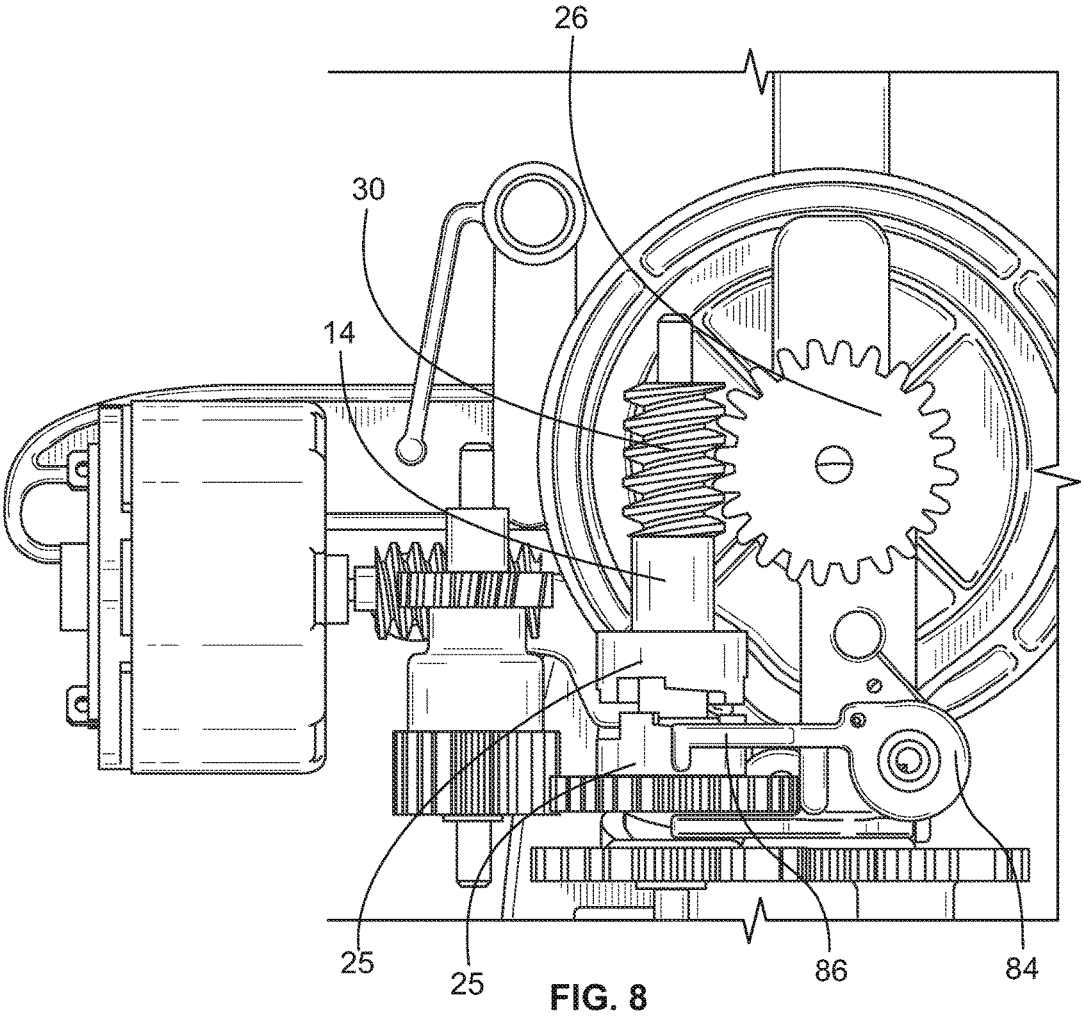
FIG. 8 is a perspective view of a gear mechanism of the present invention illustrating a worm gear directly mounted on the auxiliary gear, and further illustrating a tension spring to urge the shuttle gear into engagement with the action gear when the shuttle lock is in an inactive position.

In an alternative described embodiment, as seen in FIG. 8, the worm gear 30 mounts directly onto and extends away from the auxiliary gear 14. The pinion gear 28 is omitted condensing the gear train and reducing cost by eliminating the pinion gear 28. Elongating the auxiliary gear 14 and mounting the worm gear 30 directly thereon provides for a more reliable transmission of the drive power to an entire cam assembly 55, as seen in FIG. 3.

The shuttle lock 18 is disposed adjacent the shuttle gear 12, as seen in FIGS. 1A & 1B. The shuttle lock 18 is positioned to maintain the first working surface 12*a* of the shuttle gear with the receiving surface 14*a* of the auxiliary gear when the shuttle lock is positioned at the shuttle gear. Further, the second working surface of the shuttle gear 12*c* engages the receiving surface 16*a* of the action gear when the shuttle lock is no longer positioned at the shuttle gear, and an action element 42 moves with the action gear.

Figure 12A:
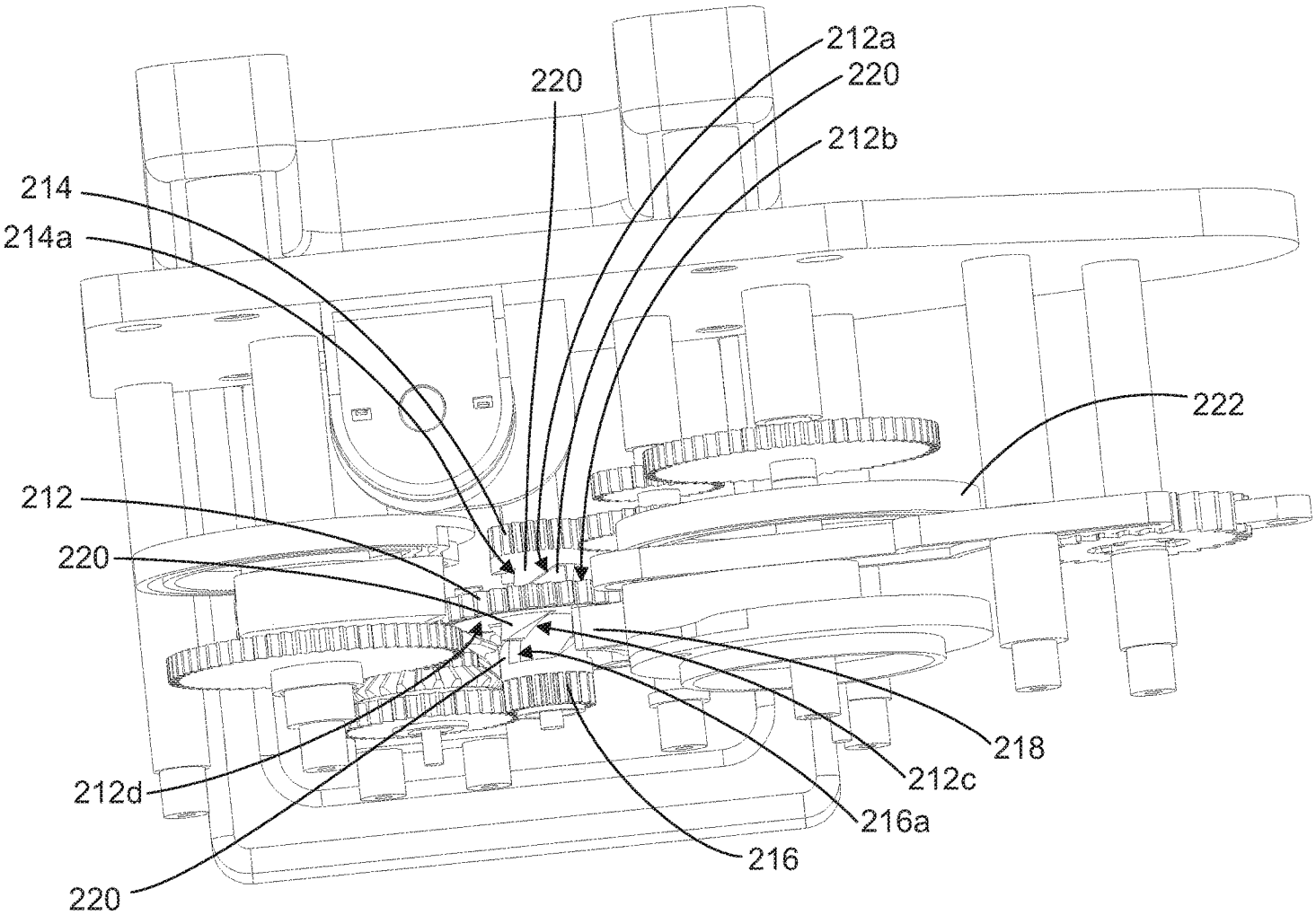
FIG. 12A & 12B are perspective views of a second alternative embodiment of the present invention illustrating first and second shuttle locks working interchangeably to alternately position a first shuttle lock at the shuttle gear to maintain the shuttle gear and auxiliary gear together in FIG. 12A, and illustrating a second shuttle lock positioned at the shuttle gear to maintain the shuttle gear and action gear together in FIG. 12B.

In the present described embodiment, an actuating mechanism is in mechanical communication with the shuttle lock positioning the shuttle lock to maintain the first working surface of the shuttle gear with the receiving surface of the auxiliary gear when the shuttle lock is positioned at the shuttle gear maintaining the shuttle gear and the auxiliary gear together to rotate both in a forward and a reverse direction for rotating the cam plate back and forth for operating the auxiliary elements, as seen in FIGS. 1A & 12A. The second working surface of the shuttle gear engages with the receiving surface of the action gear when the actuating mechanism no longer has the shuttle lock positioned at the shuttle gear, as seen in FIG. 1B. The actuating mechanism is employed to further utilize only a single motor to position the shuttle lock to maintain the shuttle gear and auxiliary gear together for operating the auxiliary elements with the shuttle gear engaging the action gear for movement of the action elements when the actuating mechanism no longer has the shuttle lock positioned at the shuttle gear.

In a present described embodiment, the actuating mechanism includes a cam plate 22 and shuttle lock cam follower 46 coupled to the shuttle lock providing motor driven actuation of the shuttle lock with the shuttle lock cam follower 46 riding along a first follower pathway 32 at the cam plate positioning the shuttle lock at the shuttle gear throughout a predetermined rotational range of the cam plate, as seen FIGS. 1A-1B. A motor 40 drives rotation of the shuttle gear with rotation of the motor in a first and second direction driving rotation of the shuttle gear in a forward and reverse direction. The motor 40 drives rotation of the shuttle gear with rotation of the motor in a first direction rotating the shuttle gear into engagement with the auxiliary gear activating the shuttle lock to maintain the shuttle gear and auxiliary gear together throughout a predetermined rotational range of the cam plate and rotating the cam plate back and forth for operating the auxiliary elements 34, as seen in FIG. 1A. Rotation of the motor in a second direction rotates the cam plate beyond the predetermined rotational range releasing the shuttle lock and rotating the shuttle gear into engagement with the action gear driving action movement of the toy, as seen in FIG. 1B.

Figure 14A:
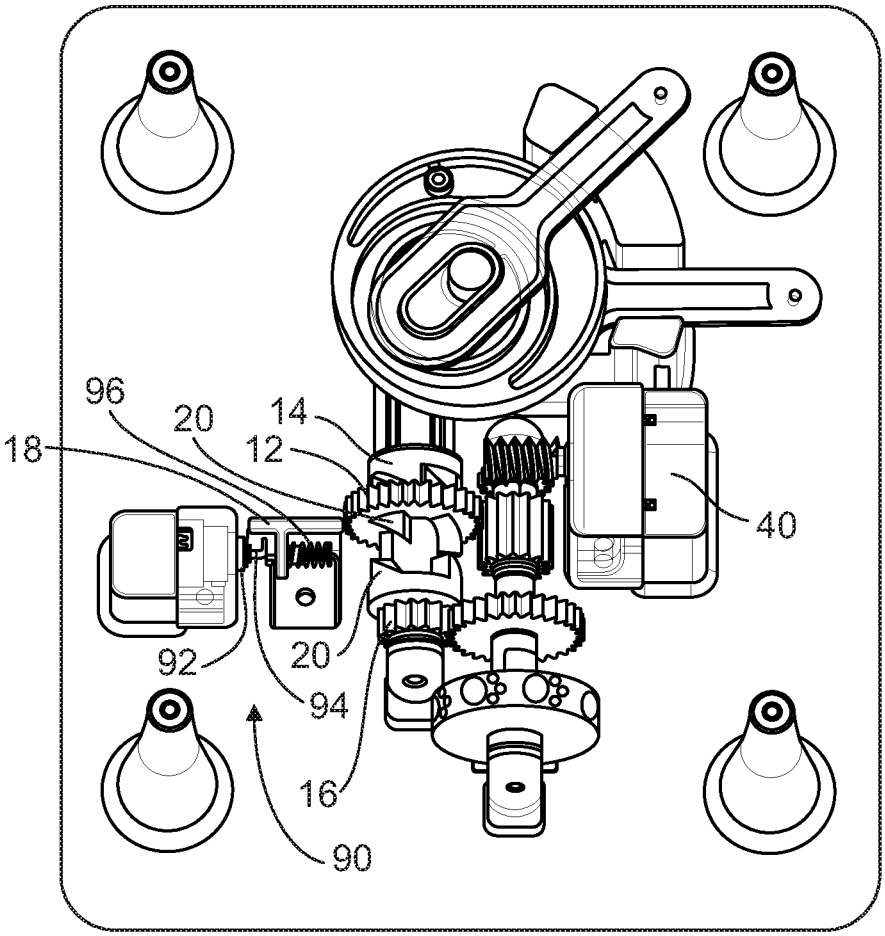
FIG. 14A is a perspective view of an alternative actuating mechanism for positioning the shuttle lock at the shuttle gear.
Figure 14B:
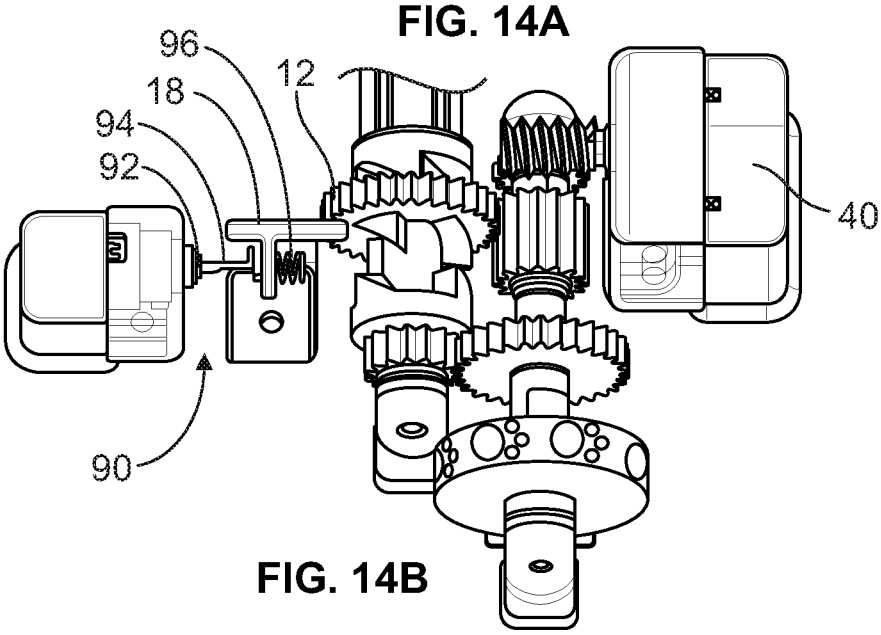
FIG. 14B is illustrating a solenoid extending and positioning the shuttle lock at the shuttle gear.

In an alternative embodiment the actuating mechanism includes a micro actuator engaging and disengaging the shuttle lock, and in an alternative embodiment, as seen in FIGS. 14A & 14B, the actuating mechanism includes a solenoid system 90 including a solenoid 92 to extend and position the shuttle lock at the shuttle gear. The solenoid includes a magnetically charged core operating a piston 94 (or screw) for positioning the shuttle lock at the shuttle gear. A spring 96 disposed adjacent the shuttle lock biases the shuttle lock out of engagement with the shuttle gear 12. The solenoid is energized in a typical manner, energizing the piston 94 to extend and position the shuttle lock at the shuttle gear. Replacing the shuttle lock cam follower with a separate actuating mechanism, ie. micro-actuator, enables the shuttle lock to be positioned at the shuttle gear separate from the cam orientation, allowing a user to select play modes for the present described toy embodiment, independent of the cam orientation which operates the auxiliary elements.

Figure 4:
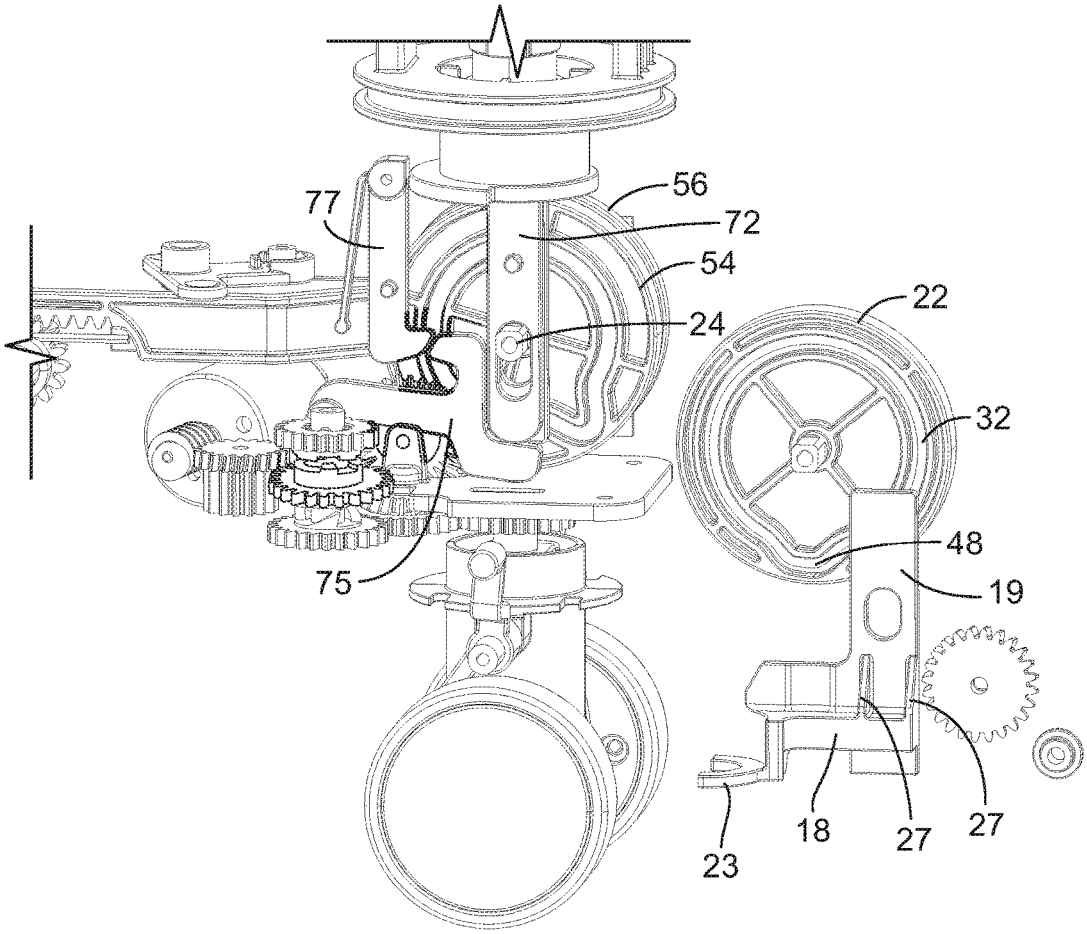
FIG. 4 is an exploded view of the gear mechanism and cam assembly illustrating the shuttle lock and first cam plate exploded from the mechanism.

In the present described embodiment, the shuttle lock 18 is mounted on the shaft 24, as seen in FIGS. 1A-1B, and disposed adjacent the shuttle gear 12 and including the cam follower 46 riding back and forth along the first follower pathway 32. The shuttle lock 18 is a generally backward L shaped plate and includes a leg 19 and a curved lock element 23, as best seen in FIG. 4, for engaging the shuttle gear 12 when the shuttle lock is in an active position. In the present described embodiment, the shuttle lock 18 is reinforced with ribs 27 affixed to or integral with the lock to help strengthen the lock to maintain its shape and integrity during use.

Figure 2:
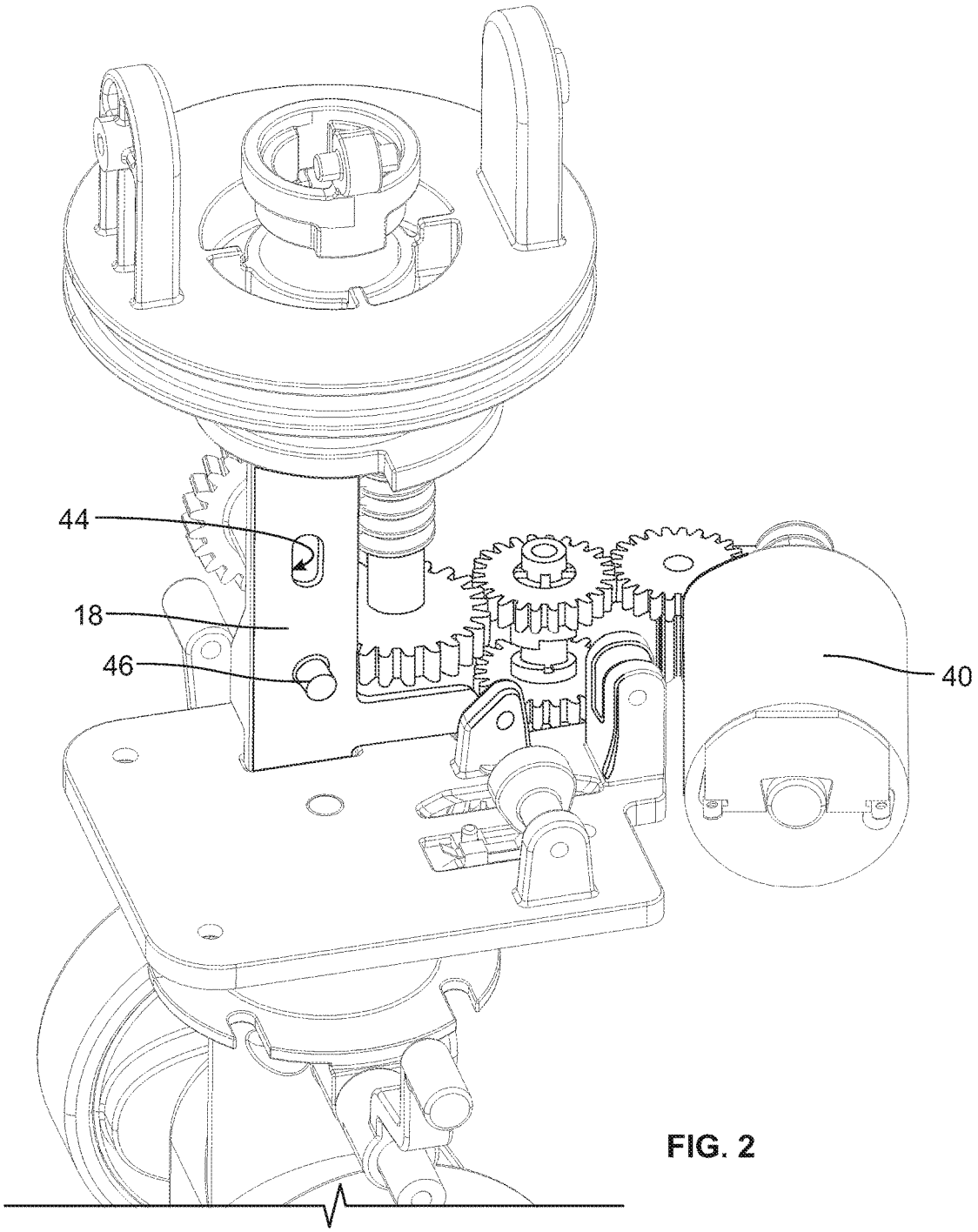
FIG. 2 is a rear perspective view of the gear mechanism illustrating a pin and an aperture at the shuttle lock.

The shuttle lock 18 includes an aperture 44 defined in the leg 19 of the shuttle lock through which the shaft 24 penetrates to mount the shuttle lock onto the shaft 24, as seen in FIGS. 1 and 2. The aperture 44 is generally oval in shape and longer than what would be required to mount the shuttle lock to the shaft 24, to allow for the up and down movement of the leg 19 of the shuttle lock on the shaft 24, as the shuttle lock shifts between positioning the shuttle lock at the shuttle gear (active position) and no longer positioning the shuttle lock at the shuttle gear (inactive position). Additionally, the shuttle lock cam follower includes a pin 46 disposed on the shuttle lock 18 for riding back and forth along the first follower pathway 32 positioning the shuttle lock at the shuttle gear maintaining the shuttle gear and auxiliary gear coupled together, as seen in FIG. 1A.

In the present described embodiment, the rotatable cam plate 22 includes at least one follower pathways 32, angularly spaced along the 360 degree rotational range reinforced periphery 38 of the cam plate. The follower pathways are organized to each dwell one or more cam followers 36 within each pathway and actuate an auxiliary element 34 operating with the cam plate through one of the followers upon rotation of the cam plate in both clockwise and counter clockwise directions.

The first follower pathway 32 includes a pathway extension 48 at the first follower pathway for capturing the pin and no longer positioning the shuttle lock at the shuttle gear, as best seen in FIG. 1B. Capturing the pin 46 in the pathway extension 48 shifts the shuttle lock 18 to an inactive position and out of locked engagement with the shuttle gear. Gravity assists the capturing of the pin 46 by the pathway extension 48 and the shifting of the shuttle lock to the inactive position when the pin drops into the extension 48. The cam plate 22, and shuttle lock cam follower 46, rotate back and forth along a predetermined rotational range of about 330 degrees of rotation before the pin 46 is captured by the extension 48, dropping the shuttle lock and no longer positioning the shuttle lock at the shuttle gear, as seen in FIG. 1B.

Further rotation of the motor in the first direction, after the pin 46 has been captured by the extension 48, rotates the shuttle gear to reengage the auxiliary gear and rotate the cam plate to force the pin 46 from the extension 48 and back into the predetermined rotational range and again positioning the shuttle lock at the shuttle gear to again allow the user to control movements of the auxiliary elements. Alternatively, rotation of the motor in the second direction, after the pin 46 has been captured by the extension 48, will rotate the shuttle gear away from the auxiliary gear and into engagement with the action gear 16 for movement of the action element 42, rather than rotating the cam and dislodging the pin from the extension at that present time.

In use the motor 40 is driven forward advancing the shuttle gear 12 into engagement with the auxiliary gear 14 and rotating the auxiliary gear which in turn rotates the cam plate 22. The pin 46 dwells in the first follower pathway 32 with the shuttle lock positioned to maintain the shuttle gear 12 and auxiliary gear 14 together. The pin 46 rides back and forth along the first follower pathway 32 as the motor is alternately driven in a forward and reverse direction to control the back and forth movements of the auxiliary elements, as desired by a user. The shuttle gear 12 is driven in a clockwise and a counter clockwise direction by a pinion gear 50 driven by a worm gear 52 mounted on the motor 40. The shuttle gear also drives the auxiliary gear in a clockwise and counter clockwise direction when the shuttle lock is positioned to maintain the shuttle gear and the auxiliary gear together.

The user can drive the motor 40 forwards and backwards to achieve the desired movements of the auxiliary elements, as long as the pin 46 dwells within the first cam follower pathway 32. The auxiliary elements can be controlled in more than just a cyclical manner, as is typically seen with a cam driven configuration, with individual auxiliary elements isolated and manipulated in any order desired by the user by rotating the cam a specified number of degrees forwards and backwards.

Additionally, computer circuitry can be utilized to establish desired movements and allows a user to easily manipulate one or more auxiliary elements with the touch of a button on a remote controller, for example, and then switch to action movements of the toy. A controller can precisely control the motor and cam rotations along with the auxiliary element movements driven by the cams. A controller can take over and complete steps to drive the motor in a correct order for engaging correct parts of the cam to complete desired actions, as well as action gears rotations moving action elements of the toy.

In an alternative embodiment, an embedded information processor circuit for the interactive plaything is identified as reference numeral 1000, with schematic block diagram including embedded processor circuitry in accordance with the present invention. An information processor may be provided as a reduced instruction set computer (RISC) controller, typically a CMOS integrated circuit providing the RISC processor with program/data read only memory (ROM). The information processor provides various functional controls facilitated with on board static random access memory (SRAM), a timer/counter, input and output ports (I/O) as well as an audio current mode digital to analog converter (DAC). The current output DACs may also be used as output ports for generating signals for controlling various aspects of the circuitry.

Additionally, the controller includes sound generating circuitry to make the toy 10 appear to talk in conjunction with the movement of the auxiliary elements 34 so as to enhance the ability of the toy to provide seemingly intelligent and life-like interaction with the user in that the toy 10 can have different physical and emotional states as associated with different coordinated positions of the auxiliary elements 34 and sounds, words and/or exclamations generated by the control circuitry.

A major advantage provided by the present toy 10 is that it is able to achieve highly life-like qualities by the precise coordination of movements of its various auxiliary elements 34 (body parts) in conjunction with its auditory capabilities in response to inputs detected by sensors thereof in a compactly sized toy and in a cost-effective manner. More particularly, the toy 10 includes a main body thereof that has a relatively small and compact form and which contains all the circuitry and various linkages and cams for the moving auxiliary and action elements in the interior thereof.

In a present described embodiment, the auxiliary gear is driven to perform a first auxiliary function and the action gear is driven to perform a second auxiliary function. The auxiliary elements operating with the cam plate 22 are driven by the auxiliary gear 14 to perform a first auxiliary function and additional auxiliary elements can be driven by the action gear 16 to perform a second auxiliary function.

Additionally, in the present described embodiment, one or more additional cam plates 54 and 56 are coaxially mounted on the shaft 24 in which the rotatable cam plate 22 and the shuttle lock 18 are commonly mounted, as seen in FIGS. 3 and 4. The additional cam plates 54 and 56 are adjacent the rotatable cam plate 22 which is driven by the auxiliary gear, and make up a cam assembly 55, or cam bank, and are also driven by the auxiliary gear. The additional cam plates, 54 and 56, are securely mounted on shaft 24 and rotated in unison with cam plate 22. Shaft 24 is keyed to a central aperture of each cam plate 22, 54 & 56 to prevent slippage of the plates while rotating on the shaft. The additional cam plates 54 and 56 each include one or more cam surface 54*a*, 54*b* and 56*a*, respectively, and one or more follower pathways 58 (pathways not seen on plate 56) at the respective cam surfaces, similar to cam plate 22, as seen in FIGS. 4 & 5.

Figure 6:
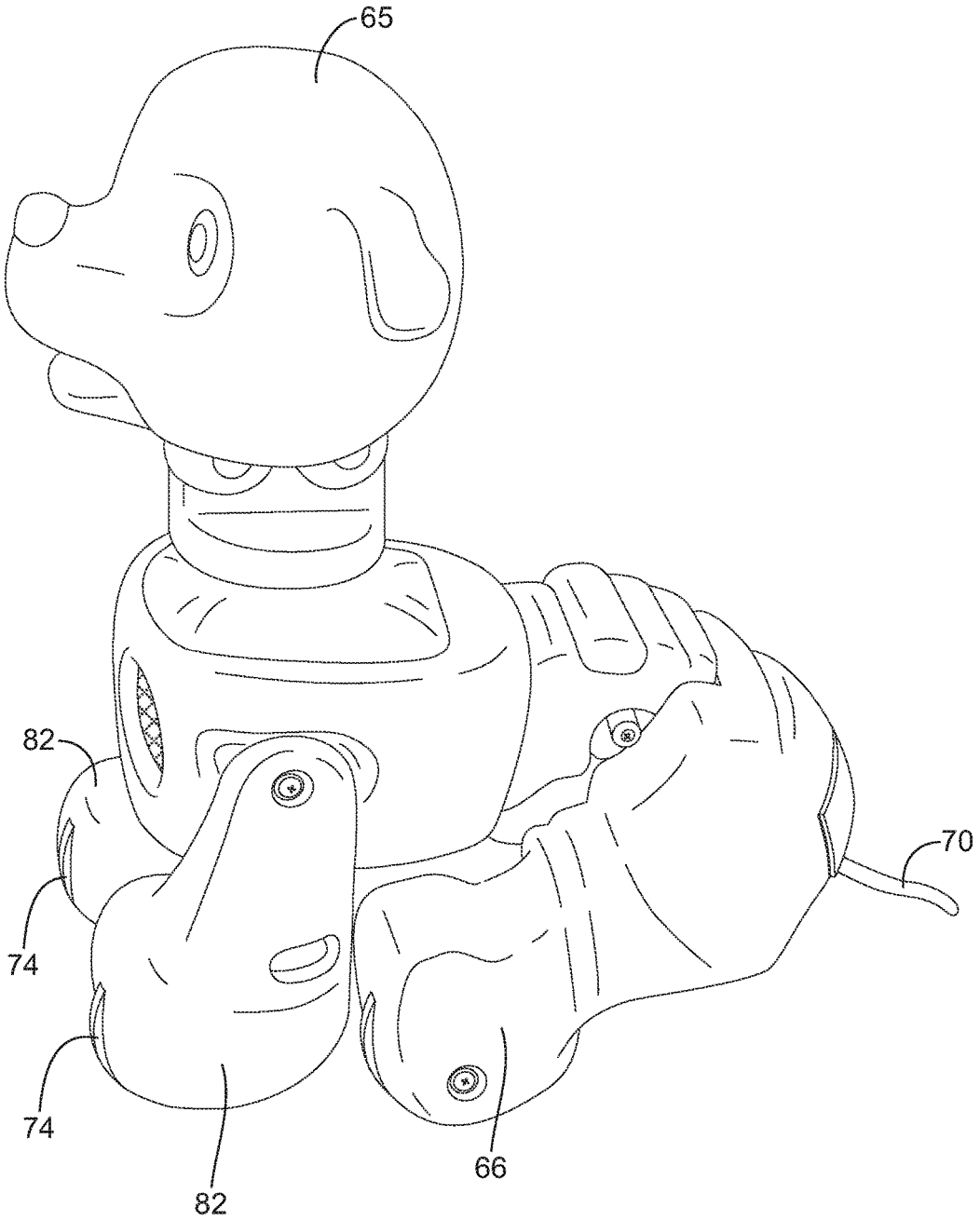
FIG. 6 is a perspective view of the present invention illustrating the auxiliary elements of an electromechanical toy puppy.

In the present described embodiment, and as seen in FIG. 6, the auxiliary elements 34 include at least one or more of the following: a head element, mouth element, snout element, hind legs element and tail element. Other auxiliary elements can also be included, such as eye and face elements, to further add life-like body and facial movements and expressions to a desired electromechanical toy. Each auxiliary element 34 moves with a cam plate (either cam 22, 54 or 56) and is linked through a cam follower to control its movements, as desired by the user. The user, for example, can tilt the head element in a cute gesture, rotate the head element upward to open the mouth with the jaw remaining fixed to mimic a barking motion, sit on the hind leg elements, and wag the tail element, in any order desired by the user, when the shuttle lock is positioned at the shuttle gear maintaining the shuttle gear and auxiliary gear together during rotation of the motor in a forward or reverse direction.

Figure 5:
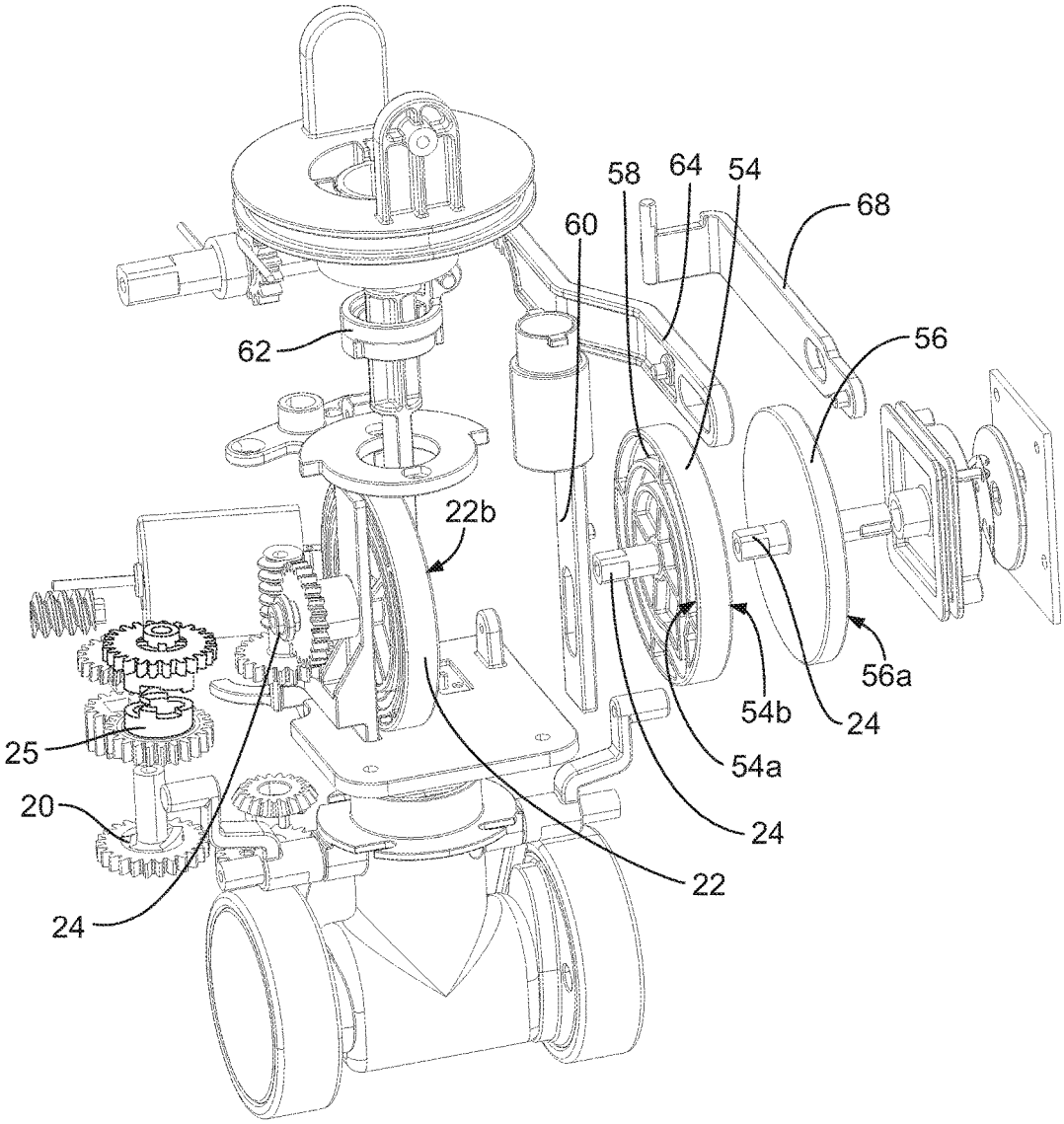
FIG. 5 is an exploded view of the gear mechanism and cam assembly illustrating three cam plates with one or more follower pathways and multiple cam followers for riding back and forth along one of the follower pathways.
Figure 7:
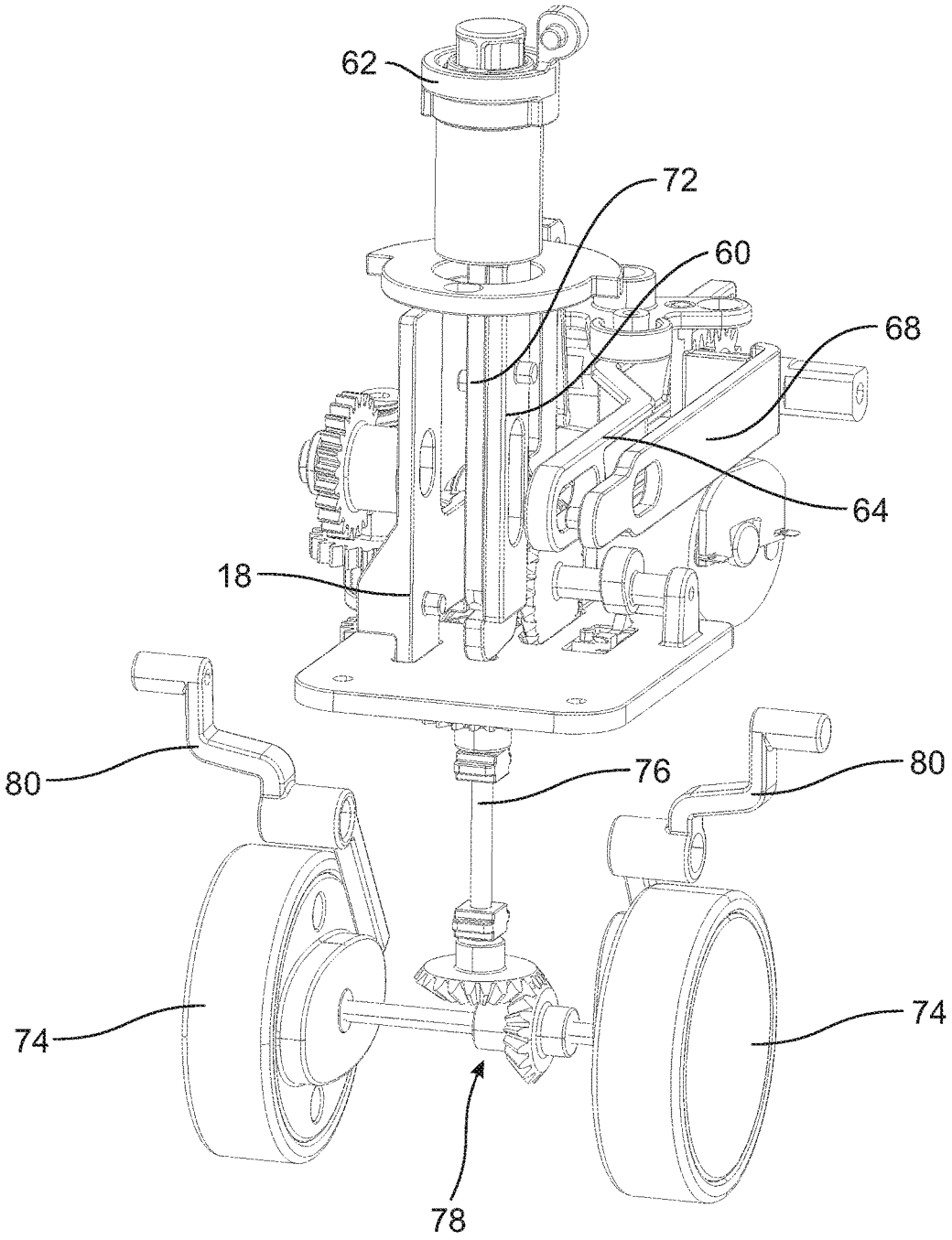
FIG. 7 is a perspective view illustrating multiple cams followers for operating multiple the auxiliary elements and an action element including wheels.

In the present described embodiment, as seen in FIGS. 5-7, tilt cam follower 60 links the head element 65 to cam plate 54 to tilt the head element to the side in a cute gesture, and swivel cam follower 62 links the head element to the cam assembly 55 to rotate the head upward to open the mouth. Additionally, sit cam follower 64 links the hind leg elements 66 to cam plate 54 to control movement of the hind legs simulating a sitting action, and tail cam follower 68 links tail element 70 to cam plate 56 and controls a tail wagging movement. Also, nod cam follower 72 further links the head element 65 to cam plate 22, at surface 22*b*, and along with a spring loaded lifter nod linkage 75, as seen in FIG. 4, nods the head element 65 and in combination with linkage 77 temporarily locks the head element 65 in a nodding position.

In the present described embodiment, the action element 42 further comprises one or more wheel assemblies 74 moving with the action gear for driving locomotion of the toy, as seen in FIGS. 6 and 7. The shuttle gear 12 will engage the action gear 16 when the shuttle lock 18 is no longer positioned at the shuttle gear and maintaining the shuttle gear and the auxiliary gear together, as seen in FIG. 1B. An axle 76 and wheel gear assembly 78, drive the wheel assemblies 74 forward. Linkages 80, as seen in FIG. 7 couple front leg elements 82 to the wheel assemblies 74 to further give a life-like appearance to the locomotion of the toy. The leg elements 82 give the toy puppy 10 the appearance of running rather than rolling on wheels.

Additionally, in the present described embodiment, the shuttle gear 12 is further urged toward engagement with the action gear 16 with a tension spring 84, as seen in FIG. 8. The tension spring 84 is disposed adjacent the shuttle lock 18 and includes a tension arm 86 to repeatedly tap down on the shuttle gear 12 when the shuttle lock is no longer maintaining the shuttle gear and auxiliary gear together, as seen in FIG. 8. The tension spring 84 will assist in the effective engagement of the shuttle gear with the action gear, especially is situations when gravity is not be able to urge the shuttle gear toward the action gear. For example, when the electromechanical toy 10 is turned on its side or completely upside down, the tension spring 84 can work against gravity and urge the shuttle gear to engage, and stay engaged, with the action gear.

In the present described embodiment, the gear mechanism 10 is generally aligned in a vertical arrangement, as best seen in FIGS. 1A-1B, and gravity assists the capturing of the shuttle lock pin 46 by the pathway extension 48 so the shuttle lock 18 no longer maintains the shuttle gear together with the auxiliary gear and allows the shuttle gear 12 to travel into engagement with the action gear 16. In an alternative embodiment, the gear mechanism 10 is arranged in a horizontal orientation, as seen in FIG. 9, and this horizontal or lateral gear mechanism configuration is used for electromechanical toys more suited to this horizontal arrangement.

In another alternative embodiment, a first and second pinion gear are disposed adjacent a shuttle gear having a first and second working surface, with each pinion gear having a receiving surface for engaging the first and second working surfaces, respectively, of the shuttle gear. A rotating cam plate is mounted on a shaft and has a cam surface including one or more follower pathways at the cam surface, the rotating cam plate is driven by the first pinion gear. One or more auxiliary elements operate with the cam plate, and each auxiliary element includes a cam follower riding back and forth along one of the follower pathways of the cam. A shuttle locking cam is mounted on the shaft and a shuttle lock is disposed adjacent the shuttle gear. The shuttle lock includes a cam follower riding back and forth along a surface of the shuttle locking cam and an action element moves with the second pinion gear.

A motor is in mechanical communication with the shuttle gear with rotation of the motor in a first direction rotating the shuttle gear into engagement with the first pinion gear and further engages the shuttle lock device controlled by the shuttle locking cam for controlling back and forth movement of the shuttle lock. This allows auxiliary elements to run in both directions throughout a predetermined rotation of the shuttle locking cam. Further rotation of the motor or rotation of the motor in a second direction releases the shuttle lock as the cam rotates outside the predetermined range allowing the shuttle gear to shuttle to the other side into engagement with the action gear for driving action movement such as locomotion of the toy or other device.

Figure 9:
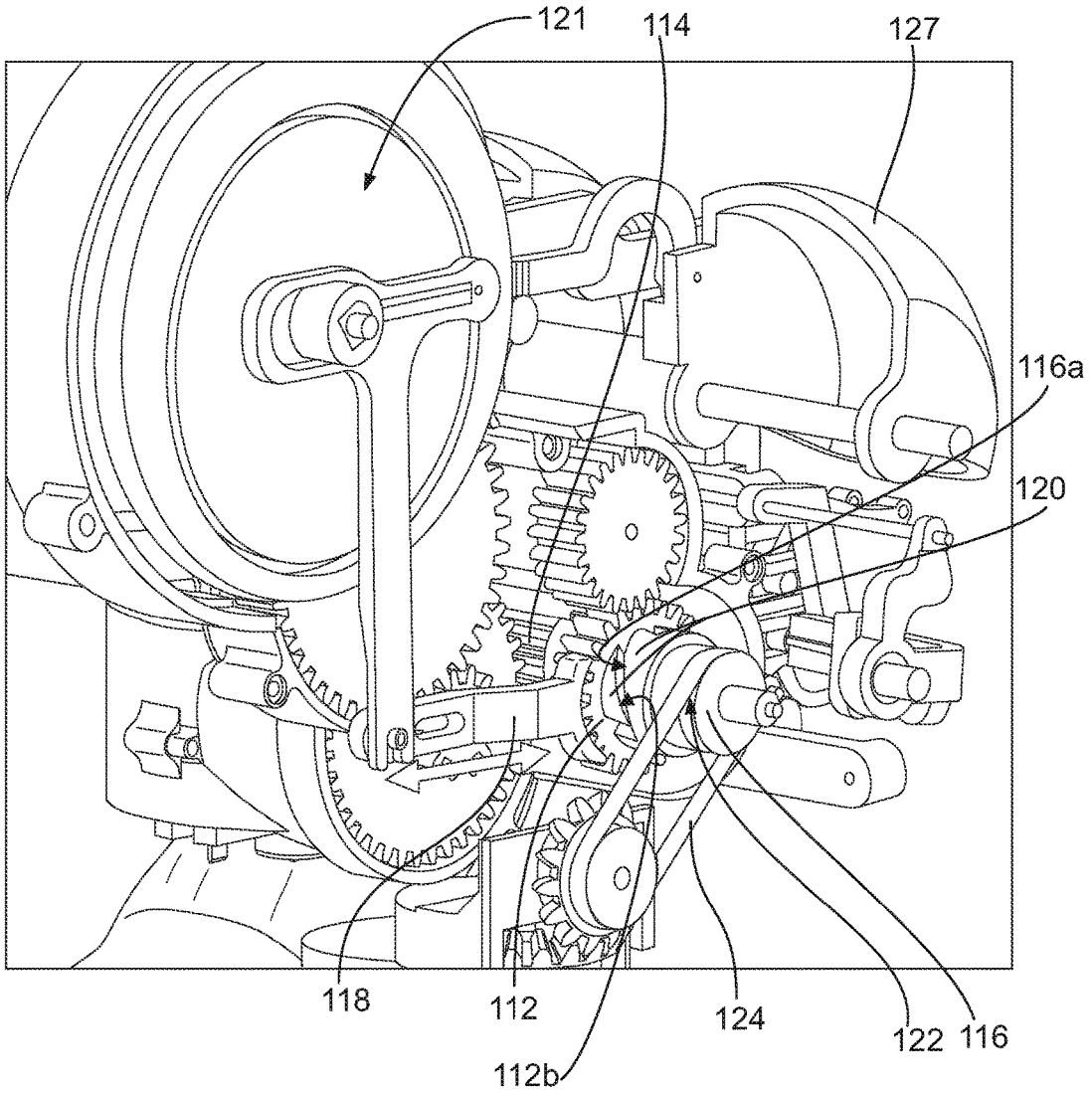
FIG. 9 is a perspective view of a gear mechanism of the present invention illustrating the gear mechanism in a lateral configuration in a first alternative embodiment.

In a first alternative embodiment, as seen in FIG. 9, the horizontal or lateral gear mechanism configuration includes a shuttle gear 112 with a first working surface (not shown) and second working surface 112*b*, an auxiliary gear 114 adjacent the shuttle gear and including a receiving surface for receiving the first working surface, and an action gear 116 adjacent the shuttle gear opposite the auxiliary gear 114, and includes a receiving surface 116*a* for receiving the second working surface 112*b*. The shuttle gear, auxiliary gear and action gear include curved sloping projections 120 at the working surfaces and receiving surfaces, respectively, for tightly engaging the shuttle gear and auxiliary gear, and/or the shuttle gear and action gear, as described above for the vertical gear mechanism embodiment. A shuttle lock 118 is disposed adjacent the shuttle gear and an actuating mechanism urges the shuttle gear toward the auxiliary gear to temporarily couple the shuttle gear and the auxiliary gear together (interfering with the shuttle gear's ability to engage the action gear) enabling the user to control back and forth movement of auxiliary elements operating with a cam system 121 driven by the auxiliary gear. The shuttle gear will engage the action gear when the actuating mechanism no longer has the shuttle lock positioned at the shuttle gear, rotating the action gear for driving action movements of the toy. Additionally, the action gear 116 includes a belt drive surface 122, as seen in FIG. 9, for mounting and securing a belt 124 to drive action movements of the toy. The lateral gear mechanism is driven by a single motor 138 and includes the cam system 120 like the vertical gear mechanism embodiment for operating auxiliary elements and actuating the shuttle lock as described above.

Figure 10:
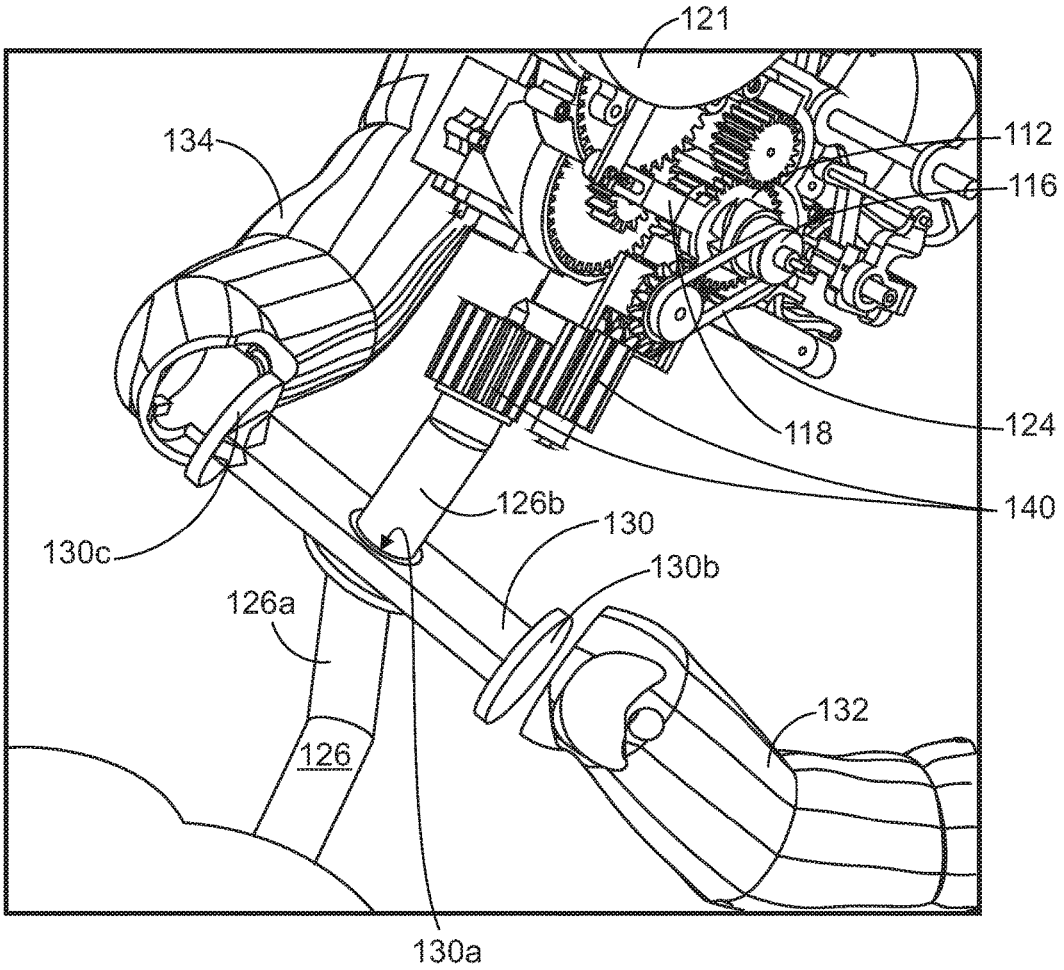
FIG. 10 is a perspective view of a first alternative embodiment of the invention illustrating a wiggle spine action element moving with the action gear.
Figure 11:
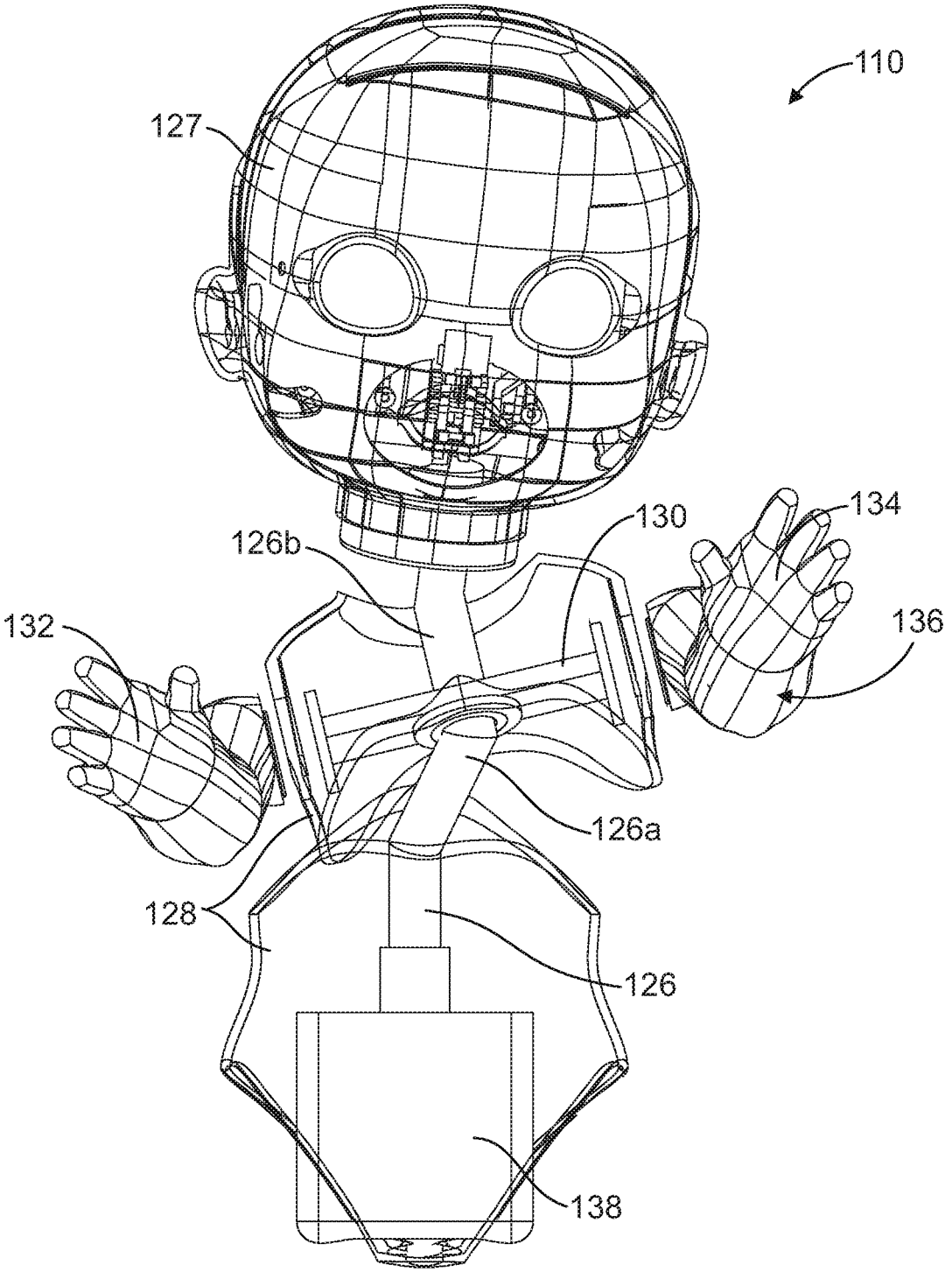
FIG. 11 is a perspective view of the first alternative embodiment illustrating the wiggle spine action element of an electromechanical toy baby doll.

In an alternative embodiment, as seen in FIGS. 9-11, an electromechanical toy baby doll 110 includes a wiggle spine 126 action element driven by the action gear 116. The wiggle spine 126 rotates through a body 128 of the toy 110 and moves with respect to a head element 127. The spine 126 extends a length of the body 128 and penetrates through a mid-point 130*a* in an arm yolk 130 which extends a width of the body 128. The wiggle spine 126 is kinked at a mid-section of the spine creating an angled spine portion 126*a* on one side of the arm yolk and an angled spine portion 128*b* on the opposite side of the arm yolk. A right arm 132 is attached to a first end 130*b* of the arm yolk and a left arm 134 is attached to a second end 130*c* of the arm yolk. A covering 136 covers right and left arms and blankets the body of the toy. In a present described alternative embodiment the covering 136 is a fabric material loosely applied to the body 136 and more snuggly applied to the arms. The covering prevents the arms from spinning completely around the wiggle spine 128 and resists the pull of the arm yolk to rotate too far to one side as the spine rotates through the middle of the arm yolk. The covering aids in helping create life-like arm waving movements to accompany the spine wiggling movements to mimic the movements of a squirming baby.

A single motor 138 drives rotation of the shuttle gear with rotation of the motor in a first direction rotating the shuttle gear into engagement with the auxiliary gear and activating the shuttle lock to maintain the shuttle gear and auxiliary gear together throughout a predetermined rotational range of a cam plate moving with the auxiliary gear and rotating the cam plate back and forth for operating the auxiliary elements linked to the cam plate for moving facial elements (lips, eyes, eye lids, etc.) to exhibit life-like facial animations and emotions. Rotation of the motor in a second direction rotates the cam plate beyond the predetermined rotational range releasing the shuttle lock and rotating the shuttle gear into engagement with the action gear driving wiggling and/or twisting body movements with the accompanying arm swinging movements to mimic life-like baby squirming. Pinion gears 140 are included in a drive gearing actuated and driven by the action gear 116, as seen in FIG. 10. Driving movement of the wiggle spine 126 creates a full body action movement in the toy 110. Rotating the unique kinked wiggle spine 126 twists the body 128 with respect to the head and torcs the arm yolk to rotate around the spine. The covering resists the pull of the rotating arm yolk resulting in the appearance of waving arms in combination with a twisting body mimicking life-like wiggling baby movements through the rotation of only the wiggle spine.

Figure 12B:
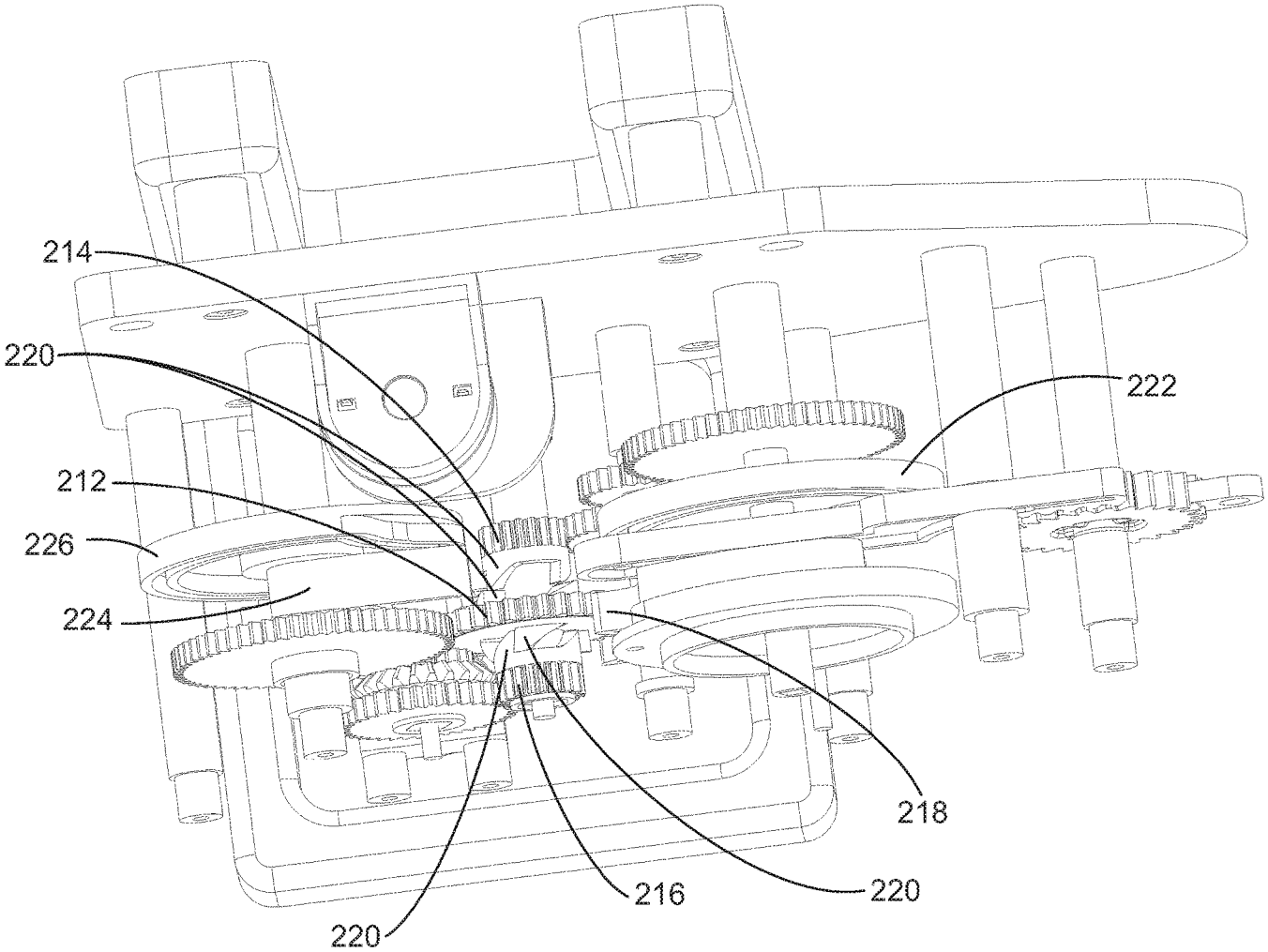
Figure 13:
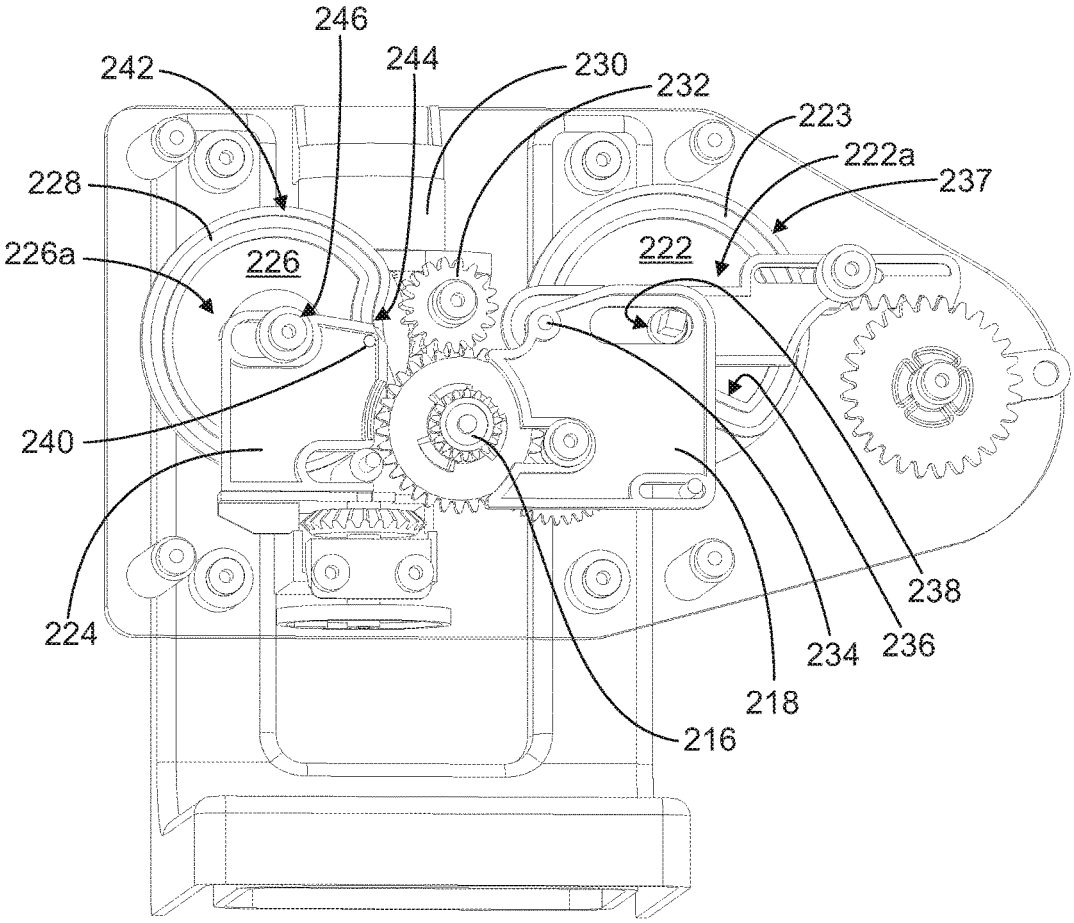
FIG. 13 is perspective view first and second actuating mechanisms of the second alternative embodiment illustrating first and second rotatable cam plates driven by an auxiliary gear and an action gear, respectively.

Additionally, in the present described alternative embodiment, the toy baby doll 110 can further include two independent banks of bi-directional cams powered by a single motor, to achieve animated facial features (lip sync/happy/sad/closing eyelids/eyes moving left & right) and also body animations. In an alternative gear mechanism, as seen in FIGS. 12 & 13, both the auxiliary movements and the action movements are driven bi-directionally off of a single motor. A second shuttle lock is included to achieve the bi-directional movements of the action elements. A double shuttle lock gear mechanism is structured and functions generally in the same way as a single shuttle lock gear mechanism for bi-directional movement of the action elements as well as the auxiliary elements. A mirror image cam arrangement and shuttle lock device is needed to achieve the bi-directional movements of the action elements as well as the auxiliary elements. The electromechanical toy of the second alternative embodiment employs a second shuttle lock device for simple yet unique controlling of forward and reverse movement of one or more action elements as well as employing a first shuttle lock for simple yet unique controlling of back and forth movement of a plurality of auxiliary element off a single motor.

In a second alternative embodiment, as seen in FIGS. 12A-13, a first and a second actuating mechanism work together and employ a first and a second shuttle lock alternately positioned at the shuttle gear to alternately achieve bi-directional movements of both auxiliary elements, such as facial features operated by a first rotating cam throughout a limited range, mimicking real life facial emotions, and action movements, such as body and limb movements operated by a second rotating cam throughout a limited range, mimicking life like body animations, all driven off a single motor.

In the second alternative embodiment, as seen in FIGS. 12A-13, the gear mechanism includes a shuttle gear 212 having a first working surface 212*a* at a first side 212*b* of the shuttle gear, and a second working surface 212*c* at a second side 212*d* of the shuttle gear. An auxiliary gear 214 is disposed adjacent the shuttle gear and has a receiving surface 214*a* for engaging the first working surface 212*a*. An action gear 216 is disposed adjacent the shuttle gear opposite the auxiliary gear and has a receiving surface 216*a* for engaging the second working surface 212*b*. The first working surface 212*a* incudes one or more curved sloping projections 220 arranged in a circular path along the first side 212*b* of the shuttle gear and the receiving surface of the auxiliary gear includes one or more curved sloping projections 220 arranged in a circular path along the auxiliary gear. The first working surface projections and the receiving surface projections of the auxiliary gear are keyed to mate with one another and tightly engage the shuttle gear and the auxiliary gear to rotate together in a forward and reverse direction. Likewise, the second working surface 212*c* includes one or more curved sloping projections 220 arranged in a circular path along the second side 212*d* of the shuttle gear and the receiving surface of the action gear includes one or more curved sloping projections 220 arranged in a circular path along the action gear. The second working surface projections and the receiving surface projections of the action gear are keyed to mate with one another and tightly engage the shuttle gear and the action gear to rotate together in a forward and reverse direction.

In a present described alternative embodiment, the curved sloping projections 220 at the first working surface 212*a* and second working surface 212*c* include three spiral surfaces for propelling the shuttle gear into engagement with either the auxiliary gear at the first working surface, or the action gear at the second working surface. The three spiral surfaces of the first working surface are sized and shaped to engage the receiving surface of the auxiliary gear, and the three spiral surfaces of the second working surface are sized and shaped to mate with the receiving surface of the action gear.

In the second alternative embodiment, as seen in FIGS. 12A-13, a first shuttle lock 218 is disposed adjacent the second side 212*d* of the shuttle gear, and a second shuttle lock 224 is disposed adjacent the first side 212*b* of the shuttle gear. A first rotatable cam plate 222 having a cam surface 222*a* and one or more follower pathways 223 at the cam surface 222*a*, is driven by the auxiliary gear. A second rotatable cam plate 226 having a cam surface 226*a* and one or more follower pathways 228 at the cam surface 226*a*, is driven by the action gear. One or more auxiliary elements operate with the first cam plate 222, each auxiliary element including a cam follower riding back and forth along one of the follower pathways, and one or more action elements operate with the second cam plate 226, each action element including a cam follower riding back and forth along one of the follower pathways.

A single motor 230 drives rotation of the shuttle gear through one or more drive pinion gears 232, with rotation of the motor in a first direction and a second direction driving rotation of the shuttle gear in a forward and a reverse direction. An actuating mechanism in mechanical communication with the first shuttle lock positions the shuttle lock to maintain the first working surface of the shuttle gear with the receiving surface of the auxiliary gear when the shuttle lock is positioned at the shuttle gear maintaining the shuttle gear and the auxiliary gear together, as seen in FIGS. 12A and 13, to rotate both in a forward and a reverse direction for rotating the first cam plate back and forth for operating the auxiliary elements. The shuttle gear engages with the receiving surface of the action gear when the first actuating mechanism no longer has the first shuttle lock positioned at the shuttle gear. A second actuating is in mechanical communication with the with the second shuttle lock positioning the second shuttle lock at the first side of the shuttle gear to maintain the second working surface of the shuttle gear together in engagement with the receiving surface of the action gear to rotate both the shuttle gear and the receiving gear together in a forward and reverse direction, as seen in FIG. 12B.

The first actuating mechanism includes a first shuttle lock cam follower 234 coupled to the first shuttle lock and a first cam follower pathway 223 at the first cam plate 222, as shown in FIG. 13. The first shuttle lock cam follower 234 incudes a pin 234 disposed on the first shuttle lock for riding back and forth along the first cam follower pathway. A generally circular portion of the first cam follower pathway 223 includes a predetermined rotational range 237 of the first cam plate 222. As the auxiliary gear 214 rotates the first cam plate 222, the pin 234 travels along the generally circular portion of the first cam follower pathway 223 within the predetermined rotational range 237, positioning the first shuttle lock at the shuttle gear 212 maintaining the shuttle gear and the auxiliary gear together, as seen in FIGS. 12A and 13, as the auxiliary gear rotates in a forward or reverse direction, for moving the auxiliary elements operating with the first cam plate 222. The first shuttle lock will remain positioned at the shuttle gear as long as the pin 234 dwells within the generally circular portion of the predetermined rotational range 237 of the first cam follower pathway 223.

As the pin 234 travels outside the predetermined rotational range 237 and through a bend 236 in the pathway 223, the pin 234 is drawn toward a center point 238 of the first cam plate and the first shuttle lock is no longer positioned at the shuttle gear. The first shuttle lock will not move into position at the shuttle gear as long as the pin 234 dwells within the bend 236 of the pathway 223 outside the predetermined rotational range 237. Further rotation of the auxiliary gear 214, in either a forward or reverse direction, will move the pin 234 along the pathway 223 and beyond the bend 236 and within the predetermined rotational range 237, to once again position the first shuttle lock at the shuttle gear for as long as the pin 234 dwells within the predetermined rotational range 237 of the first cam shuttle lock pathway 223.

The second actuating mechanism includes a second shuttle lock cam follower 240 coupled to the second shuttle lock 224 and the second cam follower pathway 228 at the second cam plate 226. The second shuttle lock cam follower 240 incudes a pin 240 disposed on the second shuttle lock for riding back and forth along the second cam follower pathway 228. A generally circular portion of the second cam follower pathway 228 includes a predetermined rotational range 242 of the second cam plate 226. As the action gear 212 rotates the second cam plate 226, the pin 240 travels along the generally circular portion of the first cam follower pathway 228 within the predetermined rotational range 242, positioning the second shuttle lock at the shuttle gear 212 maintaining the shuttle gear and the action gear together, as seen in FIGS. 12B, as the action gear rotates in a forward or reverse direction, for moving the action elements operating with the second cam plate 226. The second shuttle lock will remain positioned at the shuttle gear as long as the pin 240 dwells within the generally circular portion of the predetermined rotational range 242 of the second cam follower pathway 228.

As the pin 240 travels outside the predetermined rotational range 242 and through a curved bend 244 in the pathway 228, the pin 240 is drawn toward a center point 246 of the second cam plate and the second shuttle lock is no longer positioned at the shuttle gear. The second shuttle lock will not move into position at the shuttle gear as long as the pin 244 dwells within the curved bend 244 of the pathway 228 outside the predetermined rotational range 242. Further rotation of the action gear 216, in either a forward or reverse direction, will move the pin 240 along the pathway 228 and beyond the curved bend 244, back within the predetermined rotational range 242, to once again position the second shuttle lock at the shuttle gear for as long as the pin 240 dwells within the predetermined rotational range 242 of the second cam shuttle lock pathway 228.

In the second alternative embodiment, first and second actuating mechanisms function generally like a mirror image of each other, such that when the first cam follower 234 is within the predetermined rotational range 237 of the first cam plate 222 positioning the first shuttle lock at the shuttle gear, the second cam follower 240 is beyond the predetermined rotational rang of the second cam plate 226 and no longer positioning the second shuttle lock at the shuttle gear. Alternatively, when the first cam follower 235 has moved beyond the predetermined rotational range 237 of the first cam plate 222, the second cam follower 240 dwells within the predetermined rotational range 242 of the second cam plate 226 positioning the second shuttle lock at the shuttle gear throughout the predetermined rotational range 242 of the second cam plate 226.

It is also contemplated that the first and second actuating mechanisms can include first and second eccentric circle pathways on first and second cam arrangements or the like, working together to alternately position the first and second shuttle locks at the shuttle gear. Additionally, it is also contemplated that the first and second actuating mechanisms can include first and second micro-actuators as described above, to alternately position the first and second shuttle locks at the shuttle gear.

Animatronic creatures or figures, robot or mechanical toys requiring one bank of bi-directional cams assemblies along with an independent one directional function powered by a single motor, such as the present described embodiment, employs a single shuttle lock arrangement, while animatronic creatures or figures, robot or mechanical toys requiring two banks of bi-directional cam assemblies powered by a single motor, such as the present described second alternative embodiment, employs a double shuttle lock arrangement.

A method generating auxiliary movements with an auxiliary gear and action movements with an action gear from a single motor driving a shuttle gear, includes the steps of positioning a first working surface on a first side of the shuttle gear and a second working surface on a second side of the shuttle gear, positioning the auxiliary gear adjacent the first working surface of the shuttle gear, positioning the action gear adjacent the second working surface of the shuttle gear, receiving the first working surface with a receiving surface of the auxiliary gear, rotating a cam plate with the auxiliary gear for generating auxiliary movements with a single motor driving the shuttle gear, the cam plate having a cam surface and including one or more follower pathways at the cam surface, moving one or more auxiliary elements with one or more auxiliary element cam followers riding back and forth along one of said follower pathways, and actuating a shuttle lock disposed adjacent the shuttle gear to maintain the first working surface of the shuttle gear with the receiving surface of the auxiliary gear when the shuttle lock is positioned at the shuttle gear maintaining the shuttle gear and the auxiliary gear together to rotate both in a forward and a reverse direction for rotating the cam plate back and forth for operating the auxiliary elements. Also included are the further steps of receiving the second working surface with a receiving surface of the action gear, the second working surface of the shuttle gear engaging with the receiving surface of the action gear when the actuating step no longer has the shuttle lock positioned at the shuttle gear for moving the action gear for generating action movements with the single motor driving the shuttle gear, and the motor driving rotation of the shuttle gear with rotation of the motor in a first and second direction driving rotation of the shuttle gear in a forward and reverse direction.

The method includes the step of actuating the shuttle lock and further including the step of activating a micro actuator disposed adjacent the shuttle lock for positioning the shuttle lock at the shuttle gear to maintain the shuttle gear and the auxiliary gear together, and the method also includes the step of actuating the shuttle lock and further including the step of activating a solenoid to extend and position the shuttle lock at the shuttle gear.

The method includes the step of actuating the shuttle lock and further includes the steps of coupling a shuttle lock cam follower to the shuttle lock and retaining the shuttle lock cam follower to ride back and forth along a first follower pathway at the cam plate positioning the shuttle lock to maintain the shuttle gear and auxiliary gear together throughout a predetermined rotational range of the cam plate with the cam plate rotating back and forth operating the auxiliary elements. Additionally, the method includes the further steps of rotating the cam plate beyond the predetermined rotational range capturing the shuttle lock cam follower in an extension of the first follower pathway no longer positioning the shuttle lock at the shuttle gear and rotating the shuttle gear into engagement with the action gear driving action movements of action elements operating with the action gear.

An alternative method for driving action and auxiliary movements with a single motor in an electromechanical toy, include the steps of providing a motor, providing a shuttle gear in mechanical communication with the motor and an auxiliary gear adjacent the shuttle gear, the shuttle gear having first and second engaging surfaces and including teeth disposed at each surface, and the auxiliary gear having a receiving surface and including teeth disposed at the receiving surface to engage the teeth of the shuttle gear. Further providing a shaft, mounting a rotating cam plate on the shaft in rotatable mechanical communication with the auxiliary gear, the cam plate having a cam surface and including one or more follower pathways at the cam surface, providing one or more auxiliary elements in mechanical communication with the cam plate, each auxiliary element including a cam follower riding back and forth along a follower pathway, and mounting a shuttle lock on the shaft, the shuttle lock disposed adjacent the shuttle gear and including a cam follower riding back and forth along a first follower pathway throughout a predetermined rotational range.

Further providing an action gear disposed adjacent the shuttle gear opposite the auxiliary gear and an action element in mechanical communication with the action gear, the action gear having a receiving surface and including teeth at the receiving surface, and rotating the motor in a first direction rotating the shuttle gear into engagement with the auxiliary gear engaging the shuttle and auxiliary gear teeth and activating the shuttle lock to maintain the shuttle and auxiliary gear engagement throughout the predetermined rotational range of the cam plate rotating the cam plate back and forth driving controlled back and forth movement of the auxiliary elements. Rotating the motor in a second direction rotates the cam plate beyond the predetermined range releasing the shuttle lock and rotating the shuttle gear into engagement with the action gear, engaging shuttle and action gear teeth, and driving action movement of the toy.

The method further includes the step of providing stepped squared off teeth at the first engaging surface of the shuttle gear and providing stepped squared off teeth at the receiving surface of the auxiliary gear keyed to mate with the stepped teeth of the shuttle gear. The method also includes the step of providing a pin disposed at the shuttle lock for riding back and forth in the first follower pathway of the cam maintaining the shuttle lock in an active position and the shuttle gear in locked engagement with the auxiliary gear.

The method further including the step of providing a dwell in the first follower pathway offset from the defined pathway for capturing the pin and shifting the shuttle lock to an inactive position and out of locked engagement with the shuttle gear, and further including the step of providing a tension spring in communication with the shuttle gear urging the shuttle gear to engage the action gear when the shuttle lock is in an inactive position and out of locked engagement with the shuttle gear. The method also includes the step of providing one or more additional cam plates coaxially mounted on the shaft adjacent the rotatable cam plate and in rotatable mechanical communication with the auxiliary gear, each additional cam plate having a cam surface and one or more follower pathways at the cam surface.

From the foregoing, it can be seen that there has been provided a gear assembly for an electromechanical toy employing a shuttle lock device for simple yet unique controlling of back and forth movement of a plurality of auxiliary elements as well as driving whole toy actions such as locomotion off a single motor. While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined on the following claims when viewed in their proper perspective based on the prior art.

What is claimed is:

1. A gear mechanism for an electromechanical toy, comprising:

a shuttle gear having a first and second working surface;

an auxiliary gear disposed adjacent the shuttle gear and having a receiving surface for engaging the first working surface of the shuttle gear;

a rotating cam plate having a cam surface and one or more follower pathways at the cam surface, the cam plate being driven by the auxiliary gear;

one or more auxiliary elements operating with the cam plate, each auxiliary element including a cam follower riding back and forth along one of said follower pathways;

a shuttle lock disposed adjacent the shuttle gear;

an action gear disposed adjacent the shuttle gear opposite the auxiliary gear having a receiving surface for engaging the second working surface of the shuttle gear;

an action element moving with the action gear;

a motor driving rotation of the shuttle gear with rotation of the motor in a first and second direction driving rotation of the shuttle gear in a forward and reverse direction; and a micro actuator actuating mechanism in mechanical communication with the shuttle lock positioning the shuttle lock to maintain the first working surface of the shuttle gear with the receiving surface of the auxiliary gear when the shuttle lock is positioned at the shuttle gear maintaining the shuttle gear and the auxiliary gear together to rotate both in a forward and a reverse direction for rotating the cam plate back and forth for operating the auxiliary elements, the second working surface of the shuttle gear engaging with the receiving surface of the action gear when the actuating mechanism no longer has the shuttle lock positioned at the shuttle gear.

2. The gear mechanism according to claim 1, wherein the first working surface further comprises one or more curved sloping projections arranged in a circular path along the shuttle gear and the receiving surface of the auxiliary gear further comprises one or more curved sloping projections arranged in a circular path along the auxiliary gear, the working surface projections and the receiving surface projections are keyed to mate with one another and tightly engage the shuttle gear and auxiliary gear to rotate together in a forward and reverse direction.

3. The gear mechanism according to claim 1, wherein the actuating mechanism is magnetically operated to extend and position the shuttle lock at the shuttle gear.

4. The gear mechanism according to claim 1, wherein the auxiliary gear is driven to perform a first auxiliary function and the action gear is driven to perform a second auxiliary function.

5. The gear mechanism according to claim 1, further comprising a second shuttle lock disposed adjacent the shuttle gear for maintaining the second working surface of the shuttle gear together in engagement with the receiving surface of the action gear.

6. The gear mechanism according to claim 5, further comprising a second actuating mechanism in mechanical communication with the second shuttle lock positioning the second shuttle lock to maintain the shuttle gear and the action gear together to rotate both in a forward and reverse direction.

7. A gear mechanism for an electromechanical toy, comprising:

a shuttle gear having a first and second working surface;

an auxiliary gear disposed adjacent the shuttle gear and having a receiving surface for engaging the first working surface of the shuttle gear;

a rotating cam plate having a cam surface and one or more follower pathways at the cam surface, the cam plate being driven by the auxiliary gear;

one or more auxiliary elements operating with the cam plate, each auxiliary element including a cam follower riding back and forth along one of said follower pathways;

a shuttle lock disposed adjacent the shuttle gear;

an action gear disposed adjacent the shuttle gear opposite the auxiliary gear having a receiving surface for engaging the second working surface of the shuttle gear;

an action element moving with the action gear;

a motor driving rotation of the shuttle gear with rotation of the motor in a first and second direction driving rotation of the shuttle gear in a forward and reverse direction; and micro actuator mechanism to extend and position the shuttle lock independent of the rotating a cam plate, said micro actuator mechanism positioning the shuttle lock at the shuttle gear to maintain the first working surface of the shuttle gear with the receiving surface of the auxiliary gear.

8. The gear mechanism according to claim 7, wherein the actuator mechanism positions the shuttle lock to maintain the shuttle gear together with the auxiliary gear to rotate both in a forward and a reverse direction for rotating the cam plate back and forth for operating the auxiliary elements.

9. The gear mechanism according to claim 8, wherein the second working surface of the shuttle gear engages with the receiving surface of the action gear when the actuator mechanism no longer has the shuttle lock positioned at the shuttle gear, with the first working surface comprising one or more curved sloping projections arranged in a circular path along the shuttle gear and the receiving surface of the auxiliary gear with one or more curved sloping projections arranged in a circular path along the auxiliary gear, the working surface projections and the receiving surface projections are keyed to mate with one another and tightly engage the shuttle gear and auxiliary gear to rotate together in a forward and reverse direction.

10. The gear mechanism according to claim 7, wherein the actuator mechanism is magnetically operated to extend and position the shuttle lock at the shuttle gear.

11. The gear mechanism according to claim 7, wherein the auxiliary gear is driven to perform a first auxiliary function and the action gear is driven to perform a second auxiliary function.

12. The gear mechanism according to claim 7, further comprising a second shuttle lock disposed adjacent the shuttle gear for maintaining the second working surface of the shuttle gear together in engagement with the receiving surface of the action gear.

13. The gear mechanism according to claim 12, further comprising a second actuator mechanism in mechanical communication with the second shuttle lock positioning the second shuttle lock to maintain the shuttle gear and the action gear together to rotate both in a forward and reverse direction.

* * * * *